US010475334B1

(12) United States Patent
Stussi et al.

(10) Patent No.: US 10,475,334 B1
(45) Date of Patent: Nov. 12, 2019

(54) ACCESSIBLE PEDESTRIAN PUSHBUTTON STATION

(71) Applicants: Pelco Products, Inc., Edmond, OK (US); Novax Industries Corporation, Delta (CA)

(72) Inventors: Angela R. Stussi, Edmond, OK (US); Michael A. Rankin, Guthrie, OK (US); Kennith E. George, Edmond, OK (US); Douglas D. Gubbe, Surrey (CA); Donald M. Mamchur, Langley (CA); David P. Atnikov, Port Moody (CA)

(73) Assignees: Pelco Products, Inc., Edmond, OK (US); Novax Industries Corporation, Delta (CA)

( * ) Notice: Subject to any disclaimer, the term of this patent is extended or adjusted under 35 U.S.C. 154(b) by 0 days.

(21) Appl. No.: 16/221,845

(22) Filed: Dec. 17, 2018

Related U.S. Application Data

(62) Division of application No. 15/900,549, filed on Feb. 20, 2018, now Pat. No. 10,192,429, which is a division of application No. 14/981,054, filed on Dec. 28, 2015, now Pat. No. 10,096,239.

(60) Provisional application No. 62/098,831, filed on Dec. 31, 2014.

(51) Int. Cl.

| | |
|---|---|
| ***G08G 1/005*** | (2006.01) |
| ***G08G 1/095*** | (2006.01) |
| ***G08G 1/07*** | (2006.01) |
| ***H01H 13/00*** | (2006.01) |
| ***H01H 13/06*** | (2006.01) |

(52) U.S. Cl.
CPC ..... *G08G 1/005* (2013.01); *G08G 1/07* (2013.01); *G08G 1/095* (2013.01); *H01H 13/00* (2013.01); *H01H 13/06* (2013.01)

(58) Field of Classification Search
USPC ..... 340/944, 925, 407.2
See application file for complete search history.

(56) References Cited

U.S. PATENT DOCUMENTS 6,340,936 B1 * 1/2002 McGaffey ..... G08G 1/005 340/407.1
7,601,928 B1 * 10/2009 Magness ..... H01H 13/52 200/341

* cited by examiner

*Primary Examiner* — Brent Swarthout
(74) *Attorney, Agent, or Firm* — Mary M. Lee

(57) ABSTRACT

An accessible pedestrian pushbutton station. The station includes an articulating rear mounting structure to facilitate accurate positioning of the station on either a curved or flat surface. Additionally, slots in the rear mounting structure allow for minor positional adjustments during installation. The crossing direction arrow is easily repositioned on the front of the station without disassembling the housing. After removing the screw-mounted arrow, the plunger can be turned clockwise or counter-clockwise using only a flat-head screw driver. The plunger is balanced between oppositely biased springs. The spring-balanced plunger indirectly actuates an offset piezo bender using a flexible spring actuator and a second, offset stem bumper. This protects the piezo bender from direct pressure and potential damage. The station includes an internal speaker and the housing includes bilateral sound vents to project the sound emitted by the speaker. Baffles may be inserted in one or both of the sound vents.

10 Claims, 38 Drawing Sheets

ACCESSIBLE PEDESTRIAN PUSHBUTTON STATION

CROSS-REFERENCE TO RELATED APPLICATIONS

This application is division of co-pending application Ser. No. 15/900,549, entitled "Accessible Pedestrian Pushbutton Station," filed Feb. 20, 2018, now U.S. Pat. No. 10,192,429 which is a divisional of co-pending application Ser. No. 14/981,054, entitled "Accessible Pedestrian Pushbutton Station," filed Dec. 28, 2015, now U.S. Pat. No. 10,096,239, issued Oct. 9, 2018, which claims the benefit of U.S. provisional application No. 62/098,831 entitled "Accessible Pedestrian Pushbutton Station," filed Dec. 31, 2014. The contents of these prior applications are incorporated herein by reference.

FIELD OF THE INVENTION

The present invention relates generally to traffic devices and, more particularly but without limitation, to accessible pedestrian pushbutton stations.

BRIEF DESCRIPTION OF THE DRAWINGS

The accompanying drawings, which are incorporated into and form a part of the specification, illustrate one or more embodiments of the present invention and, together with this description, serve to explain the principles of the invention. The drawings merely illustrate a preferred embodiment of the invention and are not to be construed as limiting the scope of the invention.

DETAILED DESCRIPTION OF THE PREFERRED EMBODIMENT(S)

Figure 1:
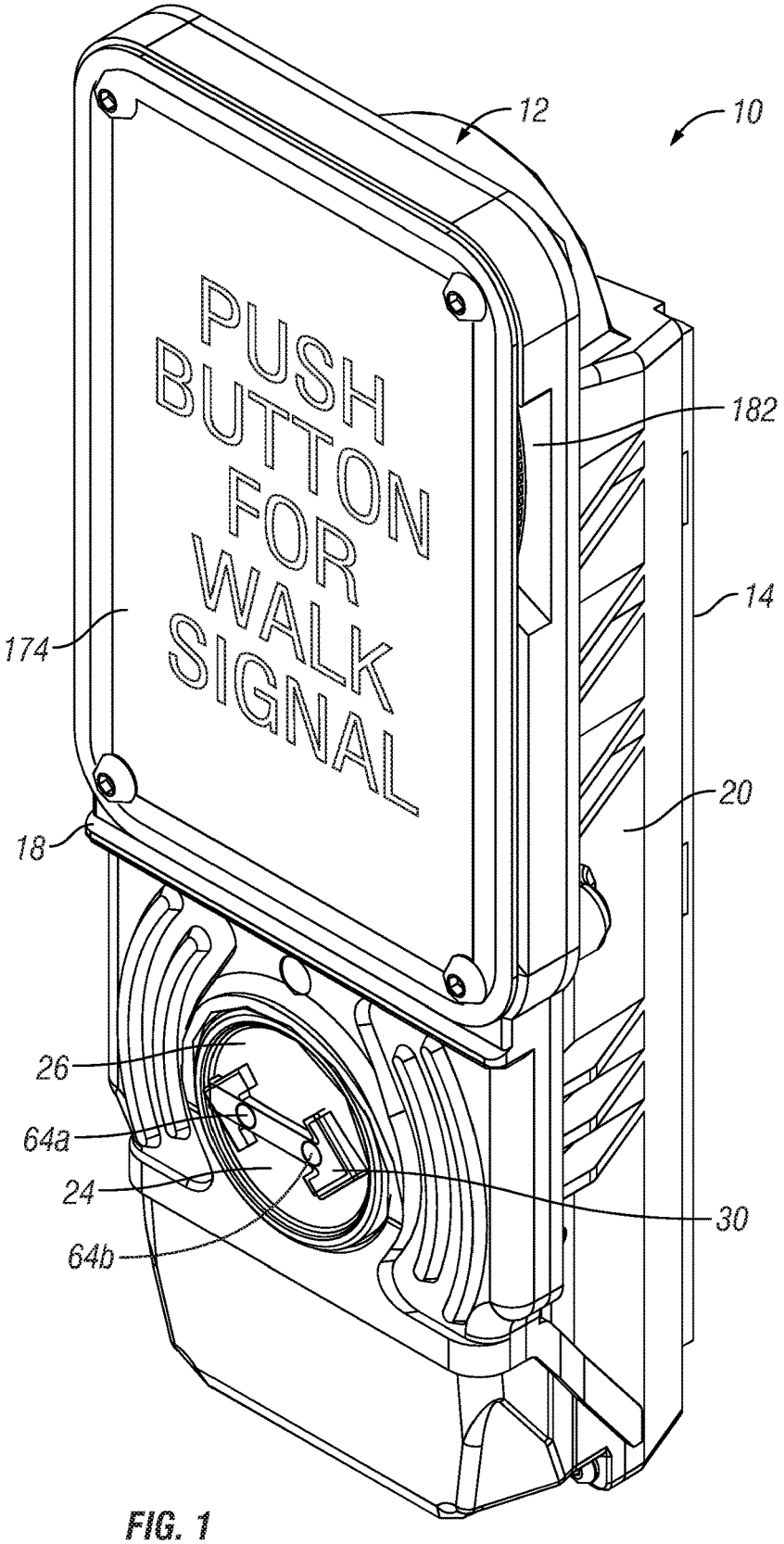
FIG. 1 is a right frontal perspective view of a fully assembled pushbutton station made in accordance with a preferred embodiment of the present invention.

APS (accessible pedestrian signal) pushbutton systems assist visually impaired persons to cross a signal-controlled intersection and other pedestrian crossings. A raised arrow on the unit indicates the direction of crossing that is controlled by the unit. The unit has a pushbutton that is pressed by the pedestrian who wishes to cross. In response to pressure on the pushbutton, circuitry in the unit provides signals in a non-visual format such as audible (e.g. sounds, tones, verbal messages, etc.) or vibro-tactile (e.g. vibrating raised pushbutton surface) formats. For example, the unit will cause the pushbutton to vibrate to indicate that it is safe to cross the intersection.

APS units may be mounted on poles or posts and, thus, versatility in mounting structures is advantageous. It is also useful for the crossing direction arrow to be reversible as this facilitates placement of the unit. Piezo based activation of the pushbutton is preferred, but such devices are subject to damage from impacts. The speakers in APS systems convey various audible signals and more frequently verbal messages. In order for pedestrians to hear these messages clearly, especially at a noisy intersection, good sound projection is important. The present invention provides improvements relating to these and other important features of APS pushbutton stations.

An APS unit includes circuitry that controls the various functions of the unit. For example, an APS unit will include a circuit board inside the housing to interact with pushbutton assembly and the speaker. The circuitry may also control remote devices, such as a beacons or external speakers. The circuitry is referred to herein as the "signal control assembly," and suitable systems are commercially available and so are not shown or described herein in detail. One particularly preferred signal control assembly for use in the present APS pushbutton station is shown and described in U.S. Pat. No. 8,665,115 issued on Mar. 4, 2014, and entitled "Accessible Pedestrian Signal System," which patent is incorporated herein by reference.

Turning now to the drawings in general and to FIGS. 1-4 in particular, there is shown therein an accessible pedestrian signal pushbutton station constructed in accordance with a preferred embodiment of the present invention and designated generally by the reference number 10. The pushbutton station 10 is mountable to a vertical support (not shown), such as a pole, post or wall. The station 10 generally comprises a housing 12 and a rear mount 14 that attaches the station 10 to the vertical support.

The housing 12 defines an enclosure to contain the various components and may include a front 18 and a back 20 that are bolted together with a main seal 22 (FIG. 80C) between. The station 10 comprises a pushbutton assembly 24 that includes a plunger 26 supported in a plunger space 28 (FIGS. 19-22) formed in the front 18 of the housing 12. A crossing direction arrow 30 is attached to the front of the pushbutton assembly 24.

Figure 7:
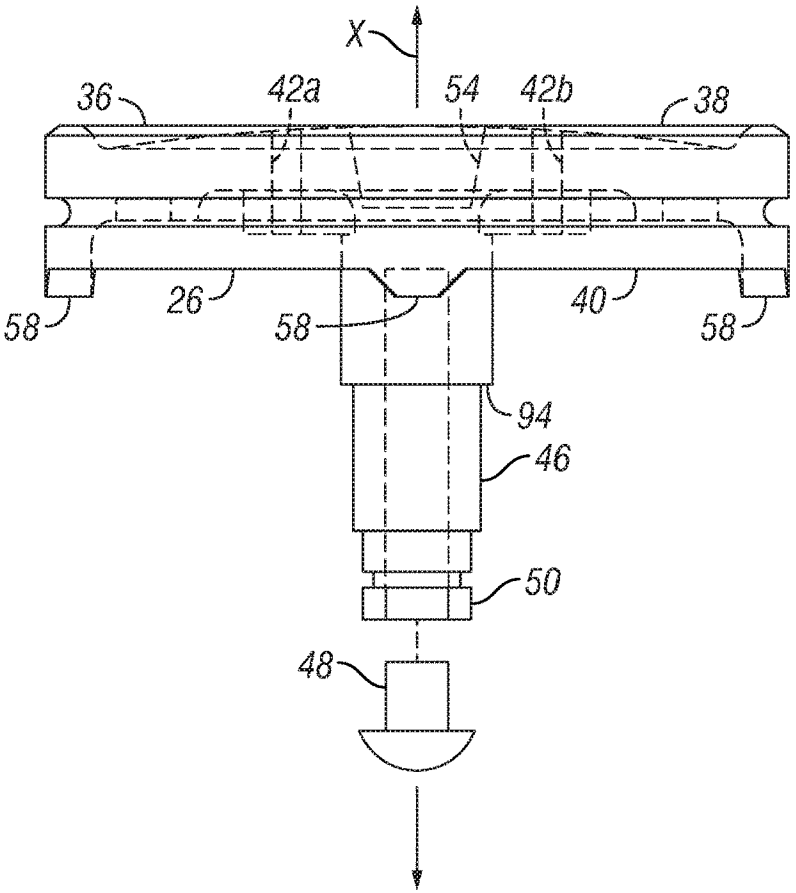
FIG. 7 is a side elevational view of the plunger.

The plunger 26 is shown in FIGS. 7 and 43-48. The plunger 26 comprises a head 36 with a front 38 and a back 40. The head 36 forms the "button" that is accessed by the pedestrian. As indicated, the crossing direction arrow 30 is attached to the front 38 of the plunger head 36. Preferably, the arrow 30 is removably and reversibly attached to the plunger head 36. To that end, a pair of screw bores 42*a* and 42*b* may be formed in the front 38 of the head 36. An elongate stem 46 extends rearward or inwardly relative to the housing 12 from the back 40 of the plunger head 36. A resilient stem bumper 48 (FIGS. 4, 5, & 10) is attached to the free end 50 of the stem 46. The stem 46 has a longitudinal axis X, as seen in FIG. 7. A slot 54 is formed in the front 38. The slot 54 is sized to receive a flat head screw driver. At least one and preferably a plurality of tabs or detents, such as the four detents 58, are provided on the back 40 of the plunger head 36.

Figure 5:
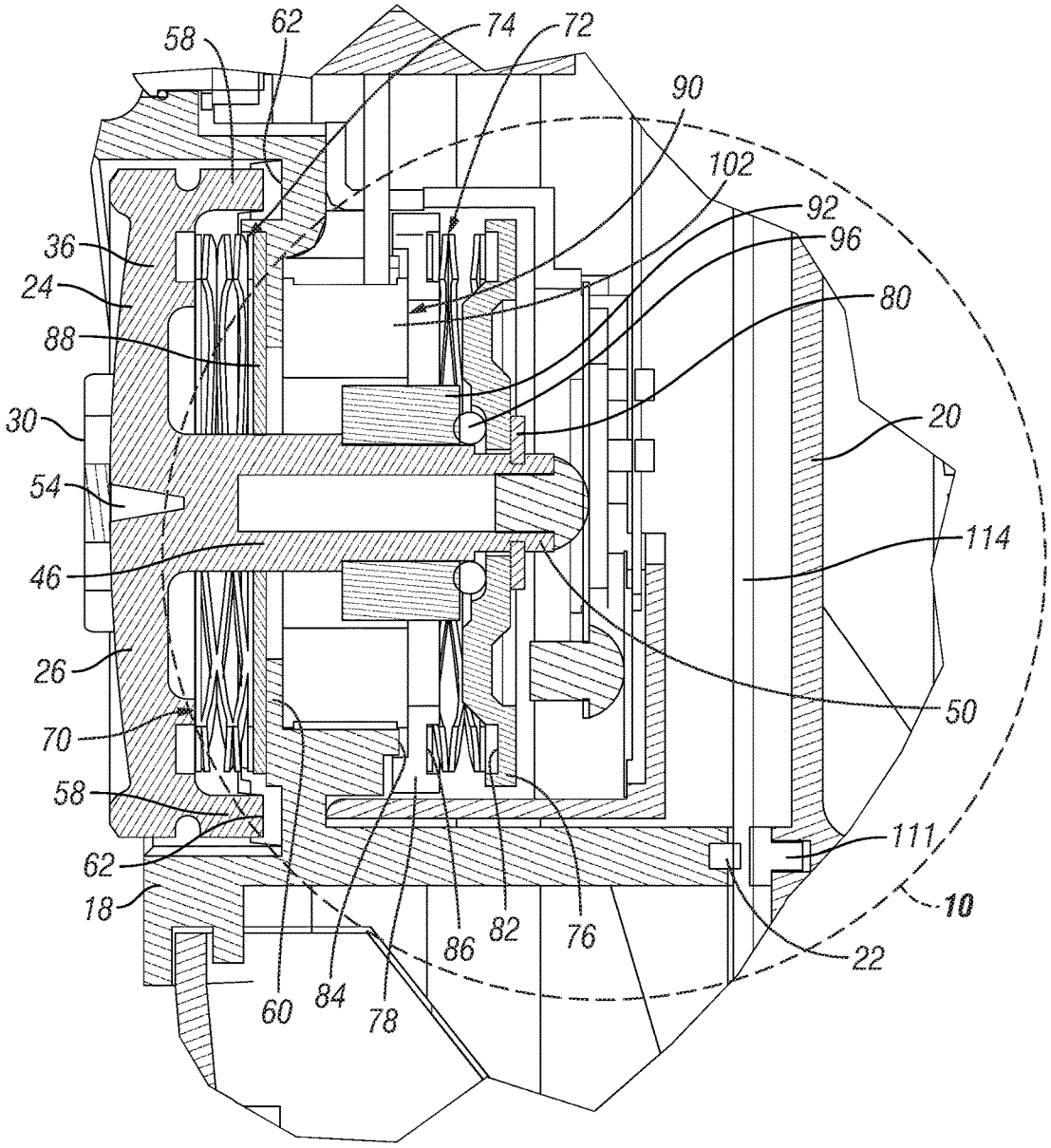
FIG. 5 is an enlarged view of the circular area designated as "5" in FIG. 4.
Figure 6:
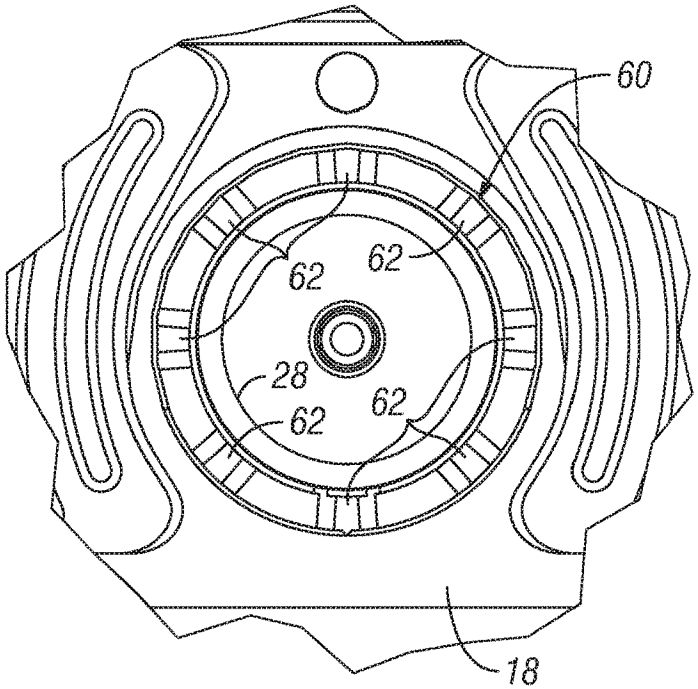
FIG. 6 is an enlarged view of the circular area designated as "6" in FIG. 2.
Figure 19:
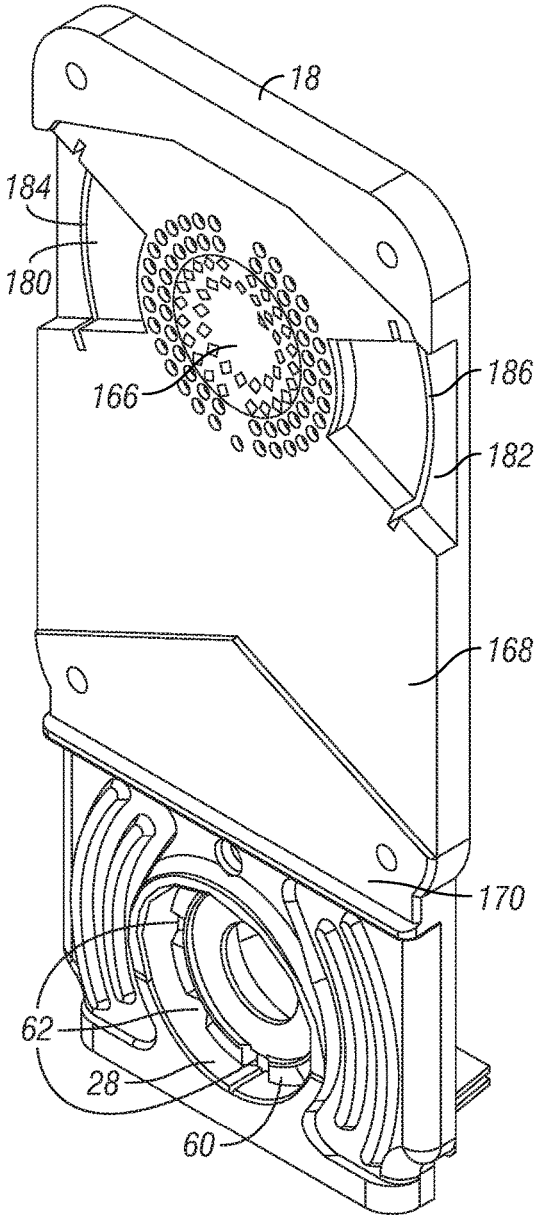
FIG. 19 is an upper right frontal perspective view of the casting front.
Figure 20:
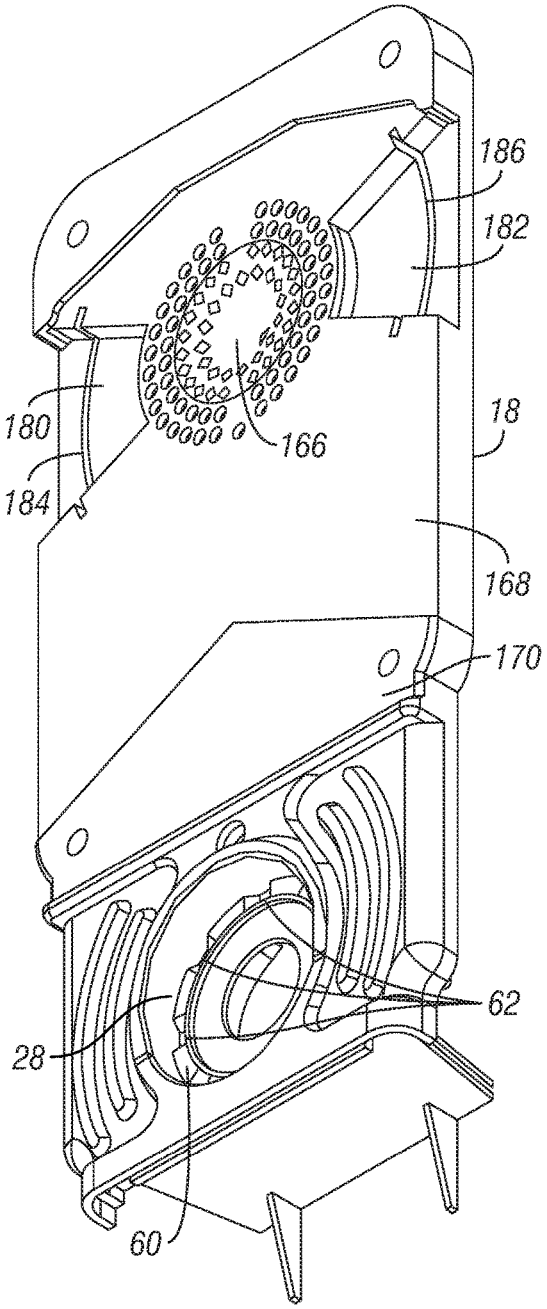
FIG. 20 is a lower right frontal perspective view of the casting front.
Figure 21:
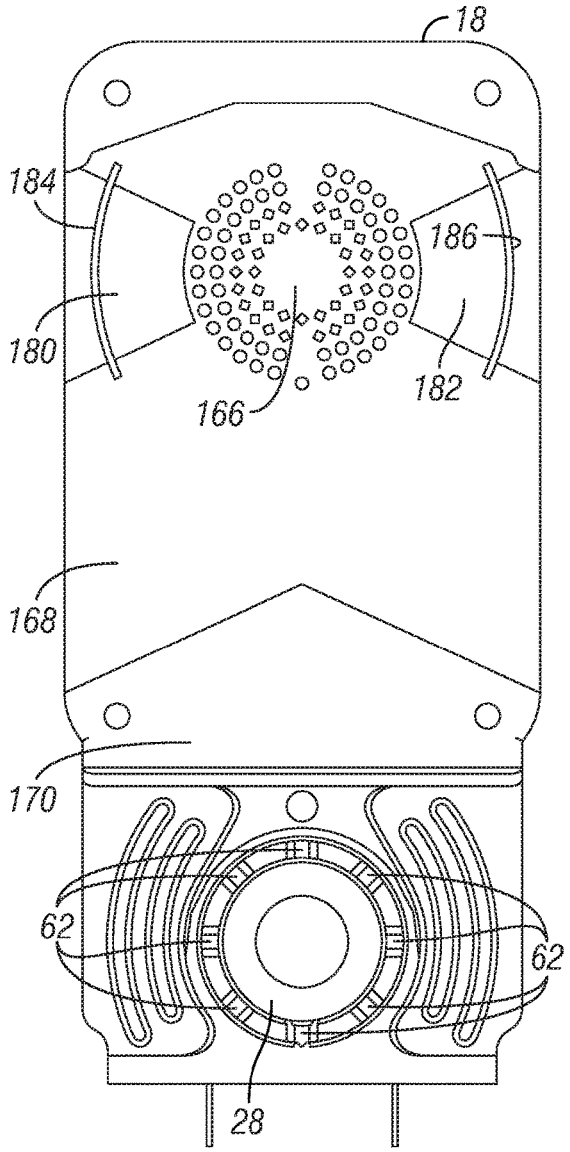
FIG. 21 is a front elevational view of the casting front.
Figure 22:
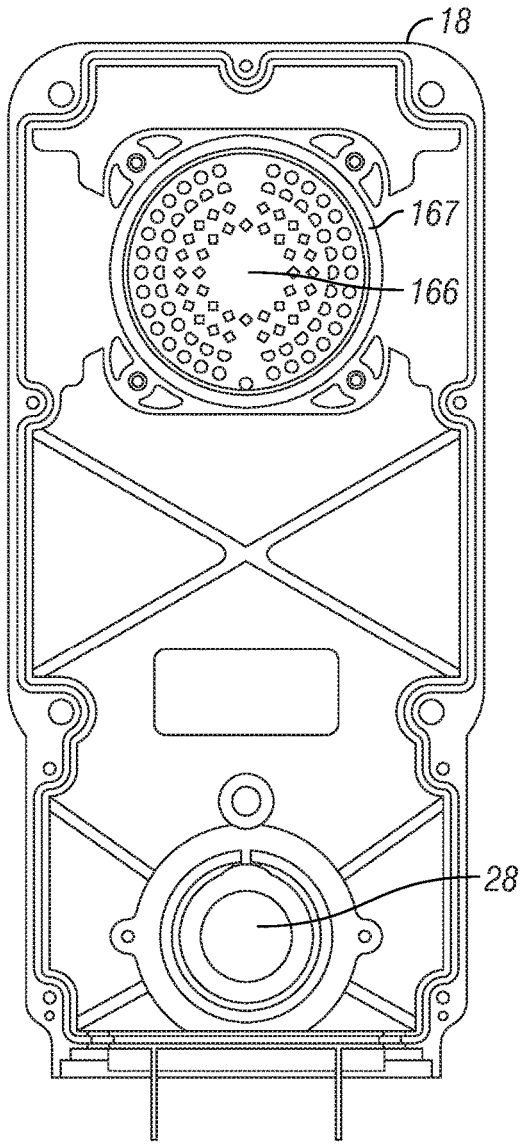
FIG. 22 is a rear elevational view of the casting front.
Figure 23:
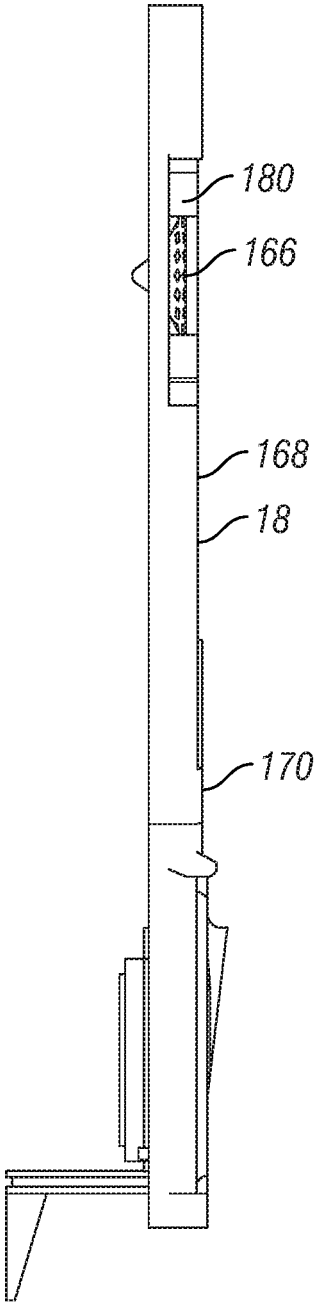
FIG. 23 is a left side elevational view of the casting front.
Figure 24:
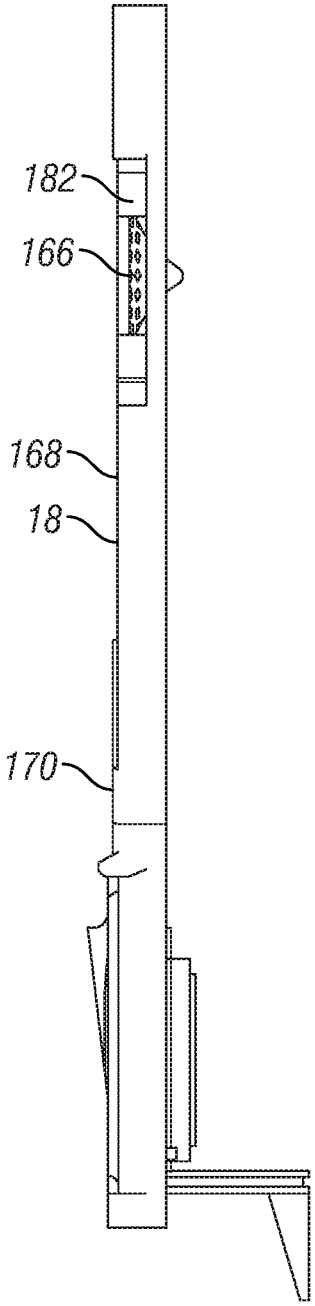
FIG. 24 is a right side elevational view of the casting front.
Figure 25:
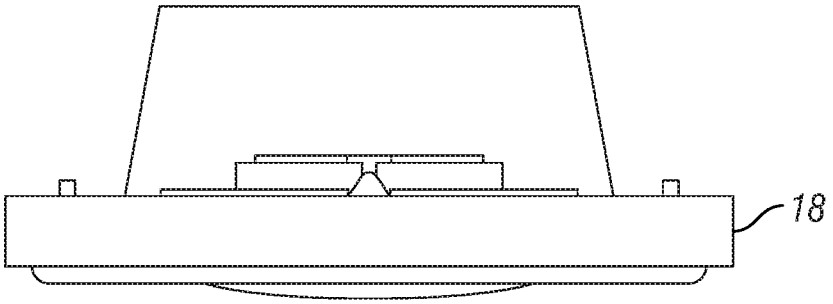
FIG. 25 is a plan view of the casting front.
Figure 26:
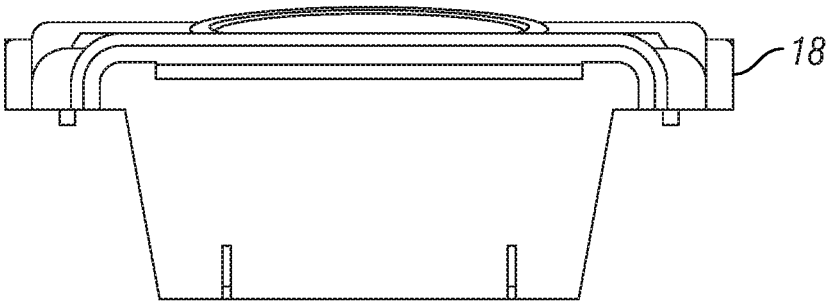
FIG. 26 is a bottom elevational view of the casting front.
Figure 46:
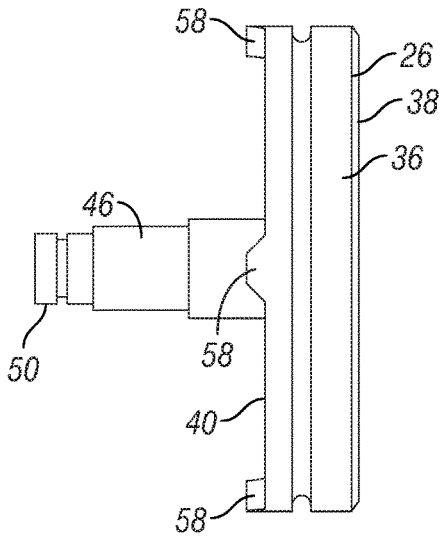
FIG. 46 is a side elevational view of the plunger.

As shown in FIGS. 6, 19, and 20, the plunger space 28 in the front 18 of the housing 12 is defined partly by an annular flange 60 (see also FIG. 5) with an outwardly facing surface that includes at least one and preferably a plurality of detent receiving notches designated collectively at 62. In the preferred embodiment, there are at least as many detent receiving notches as there are detents on the back 40 of the plunger head 36. More preferably, as shown, there are twice as many detent receiving notches, such as the eight detent receiving notches 62. As best seen in FIGS. 7 and 46, the detents 58 have downwardly converging sloped sides and a flat bottom. Likewise, the detent receiving notches 62 preferably have a corresponding shape, that is, these notches have outward diverging sloped sides and a flat bottom.

Figure 2:
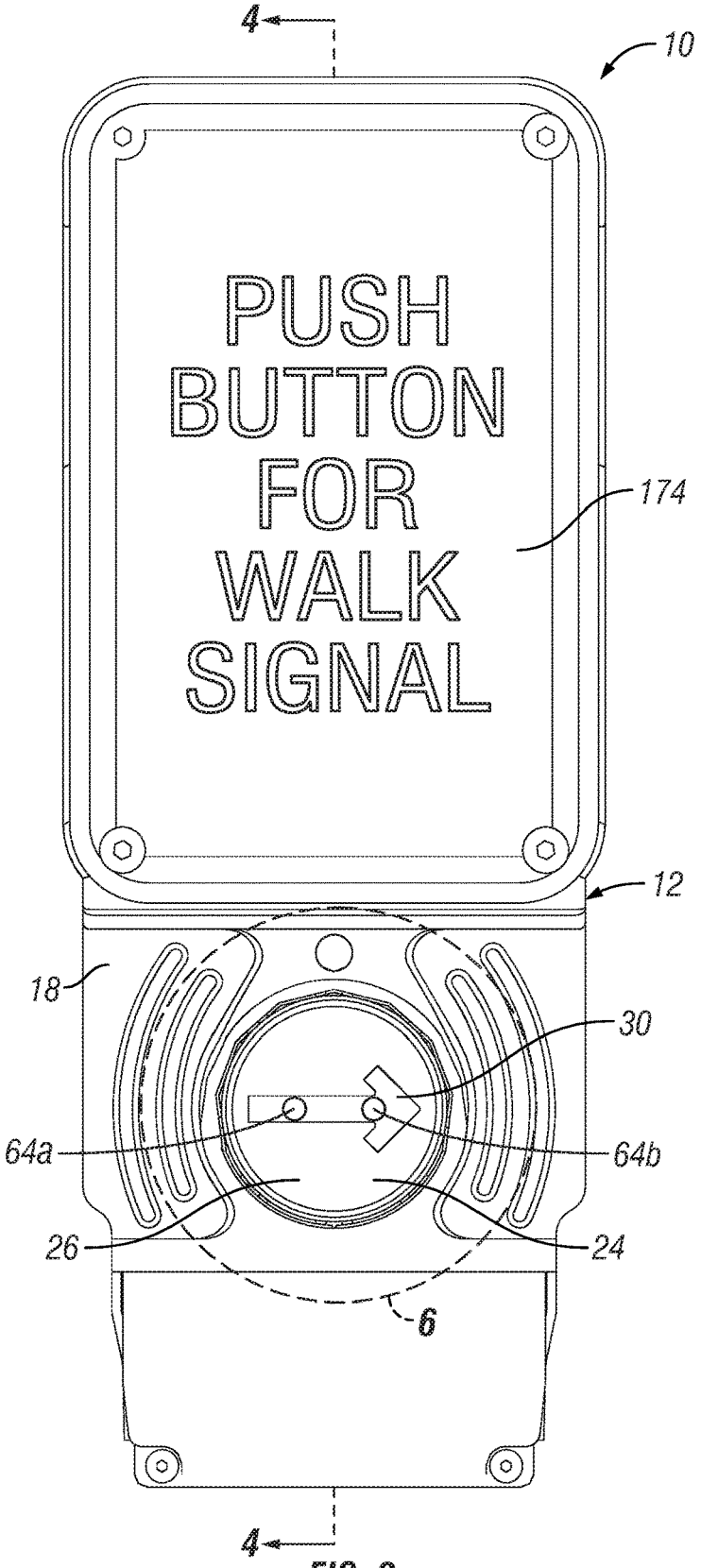
FIG. 2 is a front elevational view of the pushbutton station of FIG. 1.
Figure 3:
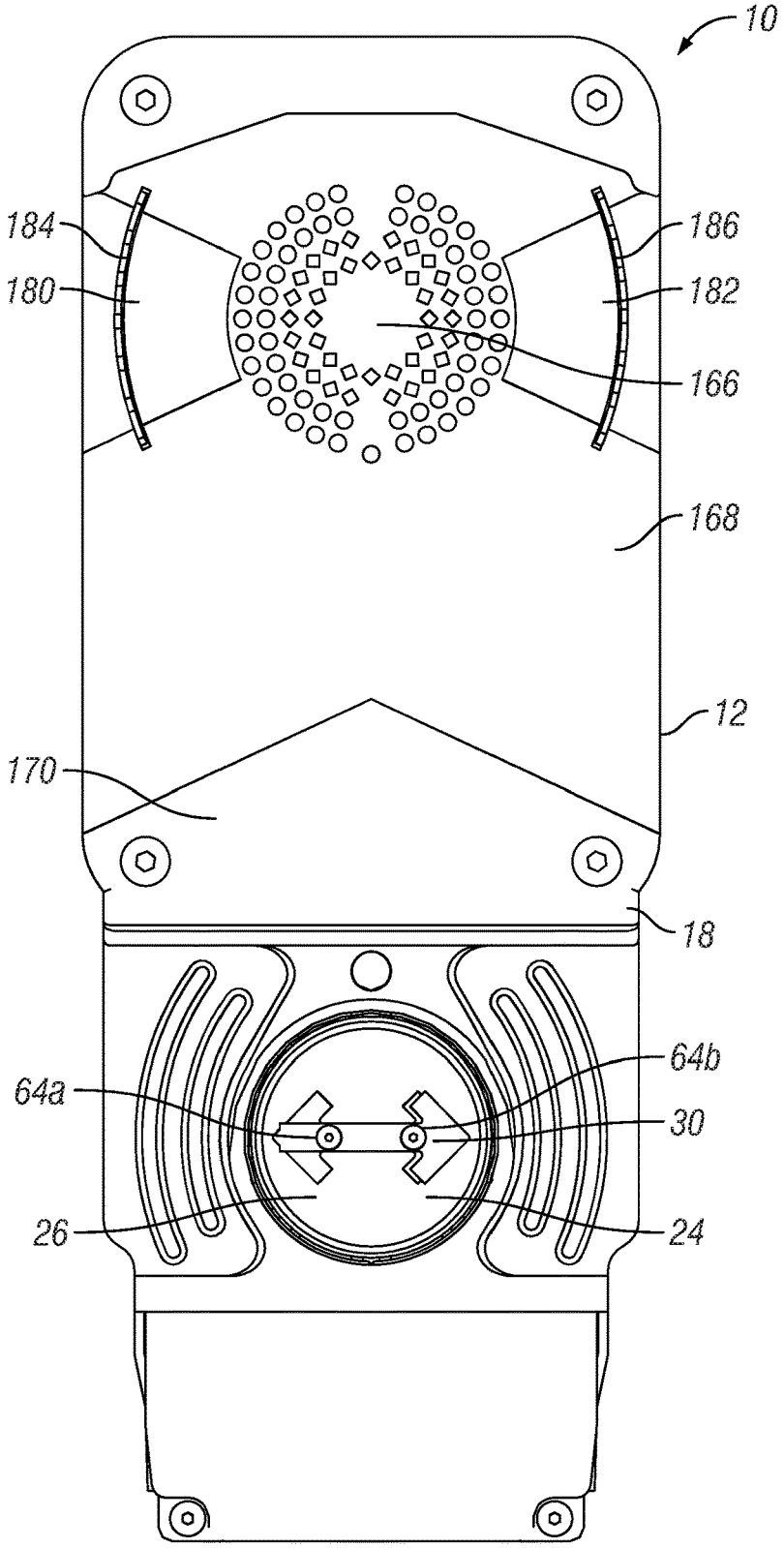
FIG. 3 is a front elevational view of the pushbutton station of FIG. 2 with the sign plate removed.

Now it will be apparent that, using a flat head screw driver in the slot 54 to urge the plunger head 36 to the right or left (clockwise or counter-clockwise), the detents 58 on the back 40 of the plunger head 36 will ride up the sloped sides of the notches 62, which in turn raises or withdraws the plunger head slightly. This allows the plunger head 36 to be positioned so that the attached arrow can point in several different directions, including right, left, up, down, and at angles therebetween. After the plunger head 36 is positioned as desired, the arrow 30 is simply reattached using the screws 64*a* and 64*b* (FIGS. 1-3).

Now it will be apparent that, in the preferred pushbutton assembly 24, the plunger 26 is mounted in the plunger space 28 of the housing 12 for axial reciprocal movement and for rotational movement. More specifically, the plunger 26 may be movable between a fixed position and an adjustment position. In the fixed or locked position, the detents 58 on the rear 40 of the plunger head 36 are received in the detent receiving notches 62 in the plunger space 28 so that rotation without axial movement is prevented. In the adjustment position, the detents 58 are withdrawn from and above the detent receiving notches 62 so that rotation of the plunger head 36 is permitted.

The pushbutton assembly 24 also preferably includes a spring assembly designated generally at 70. The spring assembly 70 may include at least one spring and preferably includes two counter biased springs including a first inner spring 72 and a second outer spring 74. As used herein, "inner," "inwardly," "rear," and "rearward," each refers to a structure or motion being closer to the back 20 of the housing 12 and further from the front 18 of the housing. As used herein, "outer," "outwardly," "forward," and "forwardly," each refers to a structure or motion being closer to the front 18 of the housing 12 and further from the back 20 of the housing.

The inner spring 72 is an annular spring supported inside the plunger space 28. The inner spring 72 is configured to produce an inwardly biasing force on the plunger 26, that is, the inner spring is configured to be compressed when the plunger moves outwardly (when rotated as described above) and then to axially bias or urge the plunger inwardly toward the housing 12. To that end, the annular inner spring 72 may be captured between an inner retaining ring or disk 76 and an outer retaining ring or disk 78, as seen in FIG. 5.

The inner retaining disk 76, shown in detail in FIGS. 49-54, is captured between the back of the spring 72 and a stop 80 (FIG. 5) near the end 50 of the stem 46. The stop 80 may take the form of a C-shaped "poodle ring," as seen best in FIG. 80B. The back of the spring 72 is received in a groove 82 in the front of the disk 76. The outer retaining disk 78, shown in FIGS. 55-60, is captured between the top of the spring 72 and the back or rear surface of the coil, which is part of the electromagnet assembly described hereafter. Thus, the outer ring 78 cannot move outwardly from the position shown in FIG. 10. The top of the spring 72 is received in a groove 86 in the back of the outer disk 78. The upper annular spring 74 is captured between the back 40 of the plunger head 36 and the outer surface of the flange 60. A silicone washer 88 may be interposed between the outer surface of the flange 60 and the bottom of the spring 74 to provide a seal around the stem 46 of the plunger.

Figure 10:
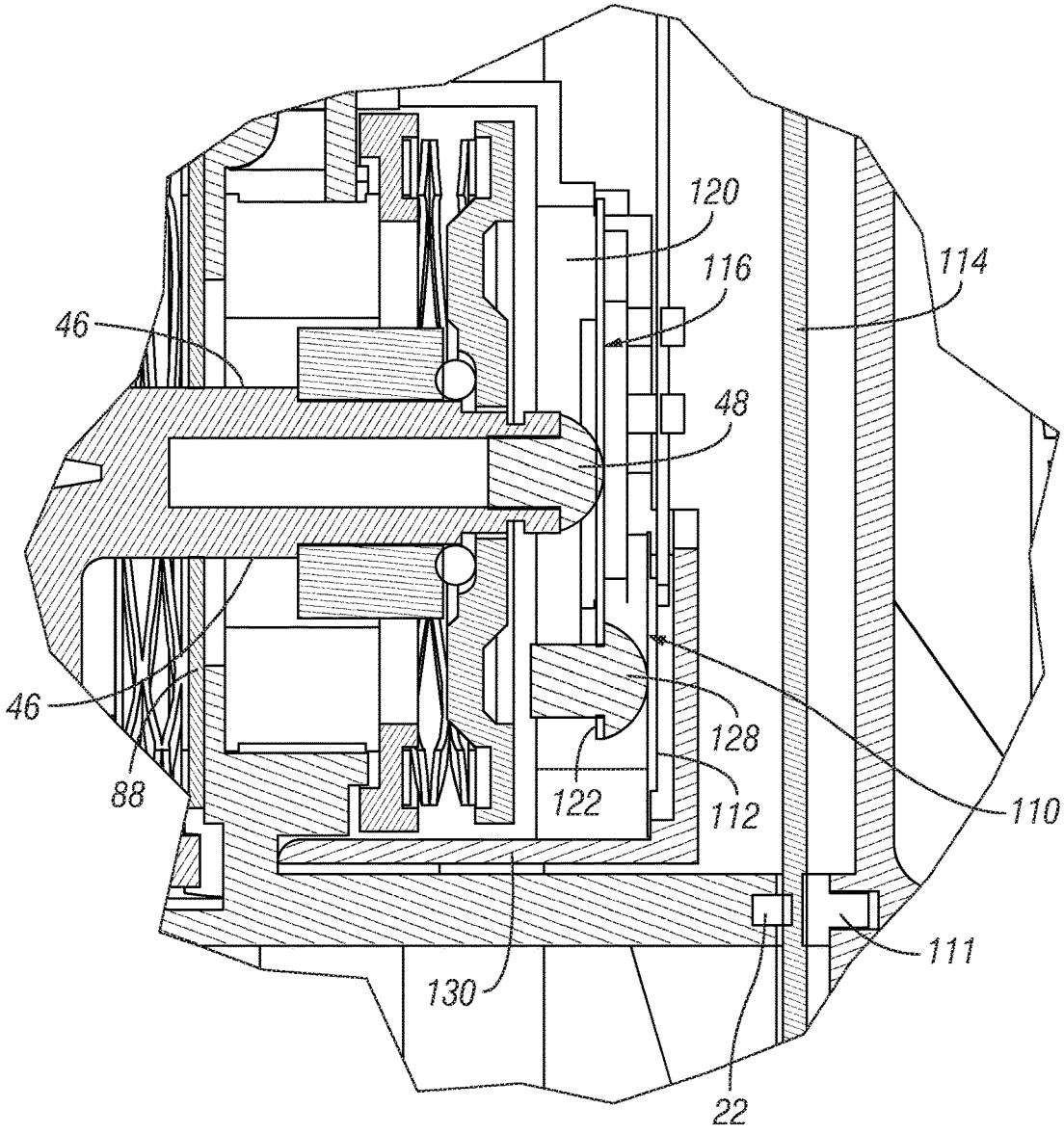
FIG. 10 is an enlarged view of the circular area designated as "10" in FIG. 5.
Figure 11:
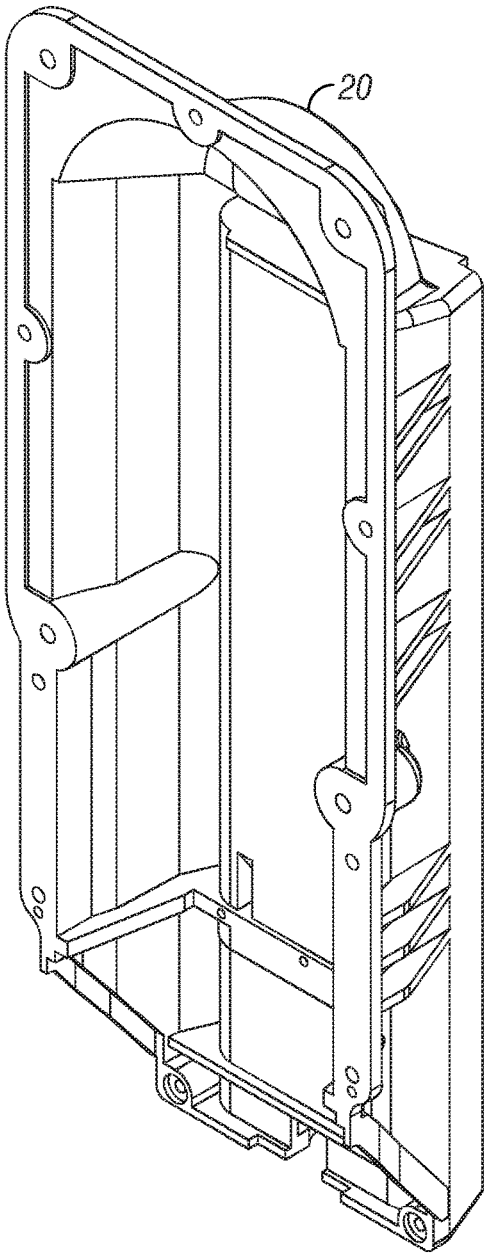
FIG. 11 is an upper right frontal perspective view of the casting back.
Figure 12:
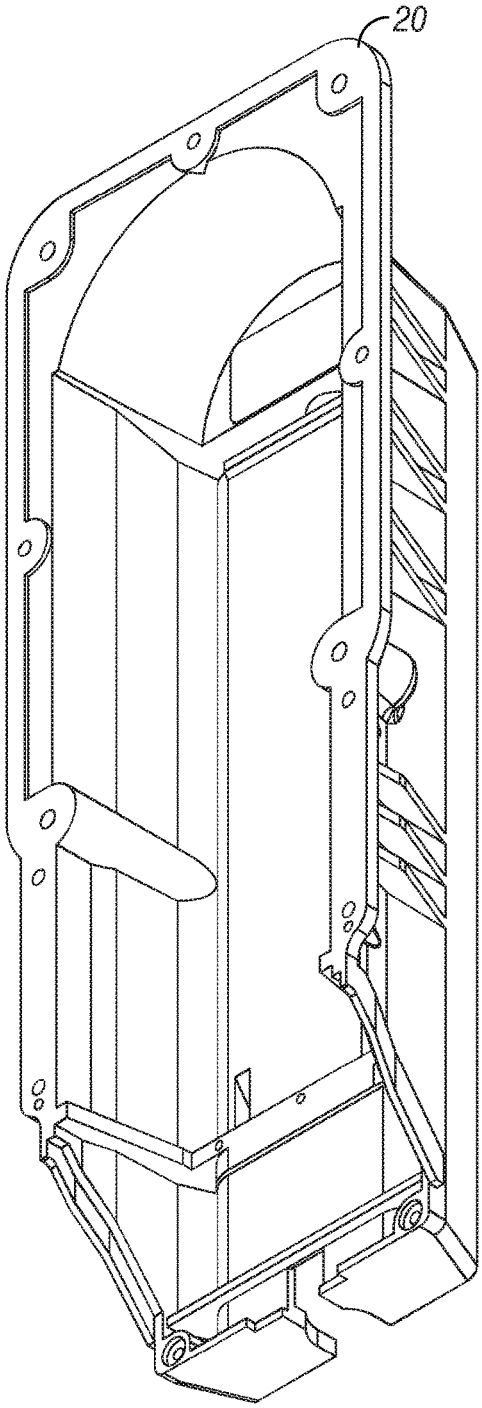
FIG. 12 is a lower right frontal perspective view of the casting back.
Figure 13:
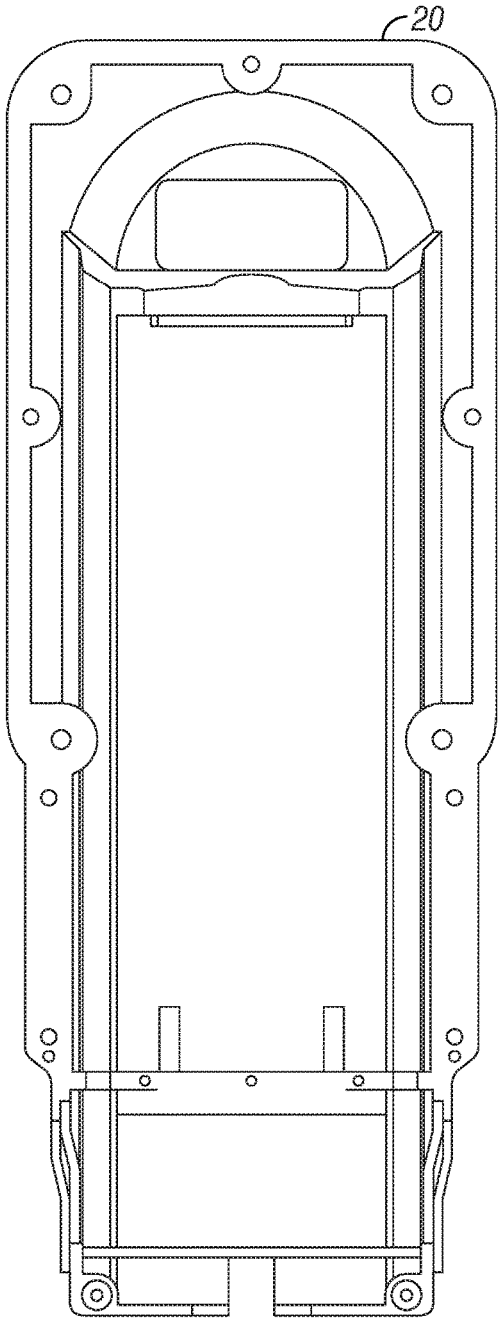
FIG. 13 is a front elevational view of the casting back.
Figure 44:
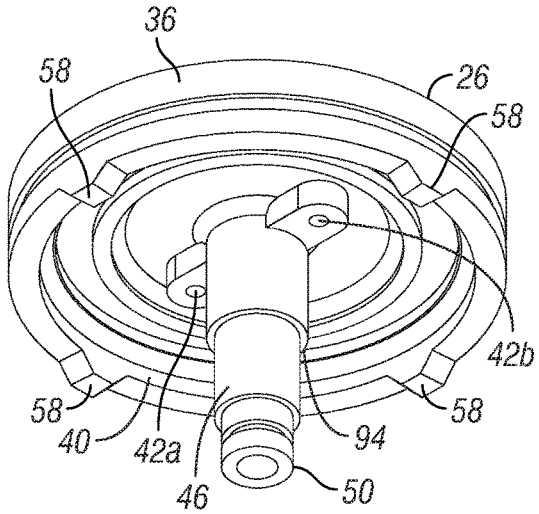
FIG. 44 is a rear perspective view of the plunger.
Figure 45:
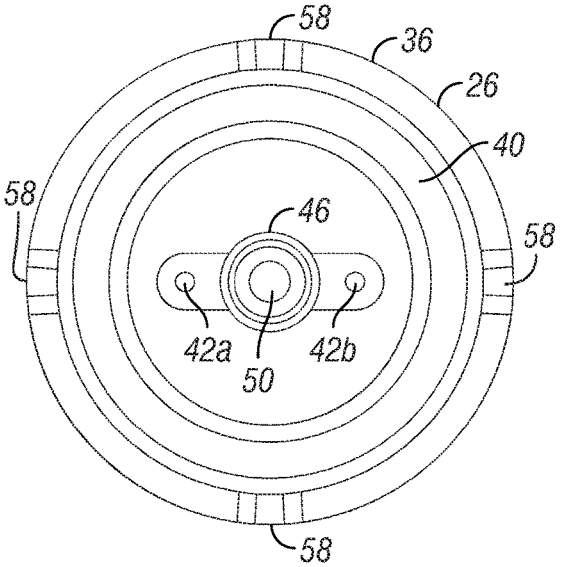
FIG. 45 is a rear elevational view of the plunger.
Figure 48:
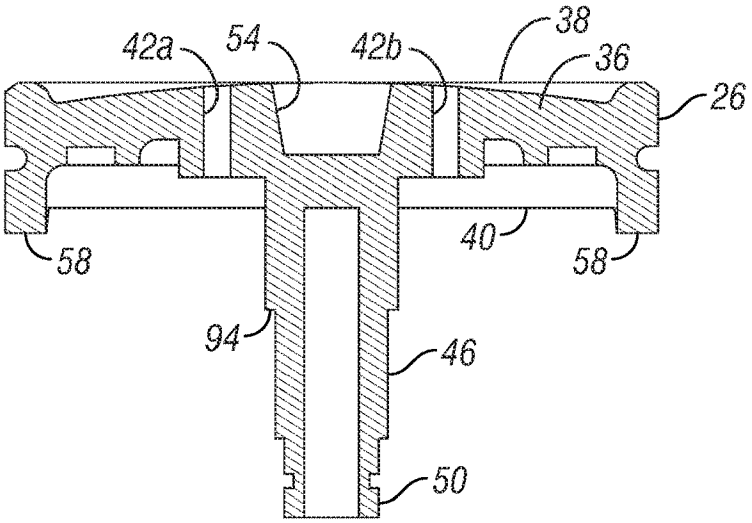
FIG. 48 is a cross sectional view of the plunger taken along the line 48-48 in FIG. 47.
Figure 47:
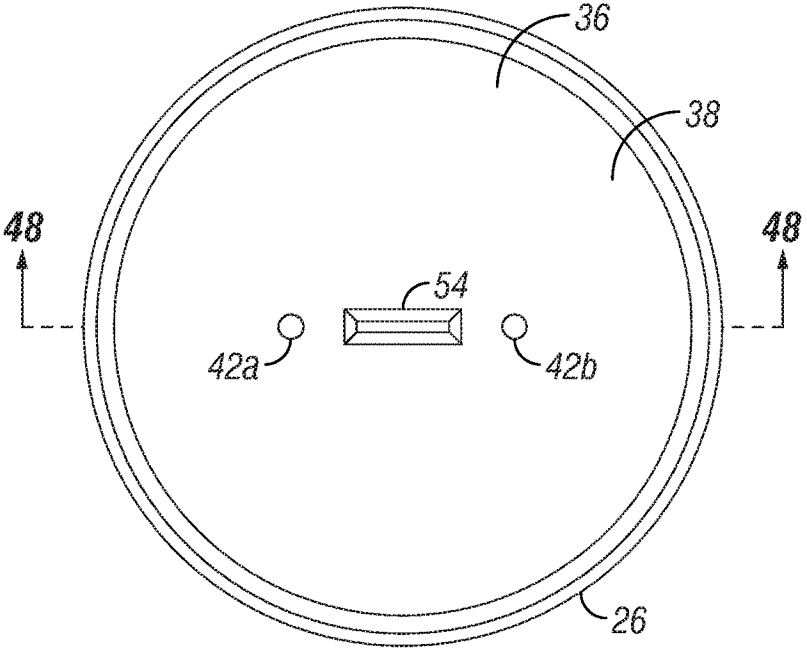
FIG. 47 is a front elevational view of the plunger.
Figure 49:
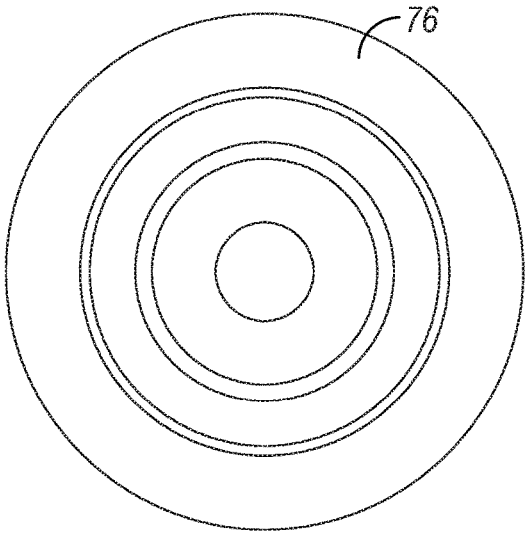
FIG. 49 is a rear elevational view of the lower retaining disk.
Figure 50:
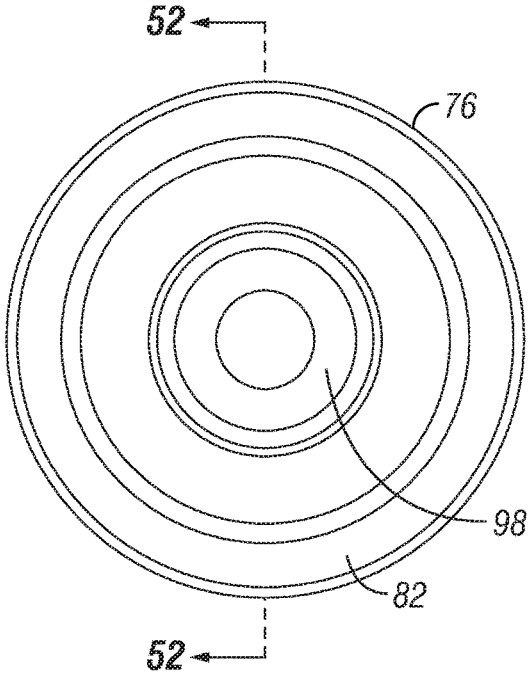
FIG. 50 is a front elevational view of the lower retaining disk.
Figure 51:
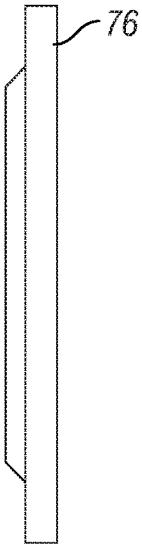
FIG. 51 is a side elevational view of the lower retaining disk.
Figure 52:
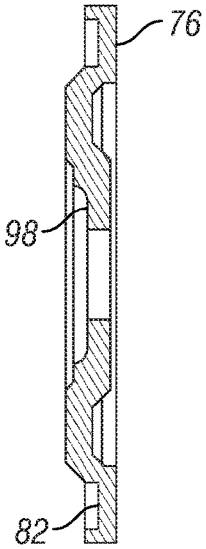
FIG. 52 is a sectional view of the lower retaining disk taken along line 52-52 in FIG. 50.
Figure 53:
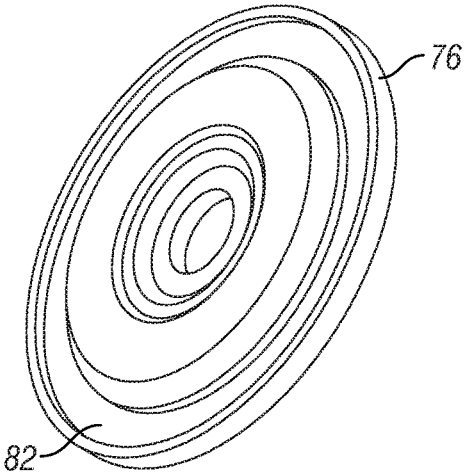
FIG. 53 is a lower right front perspective view of the lower retaining disk.
Figure 54:
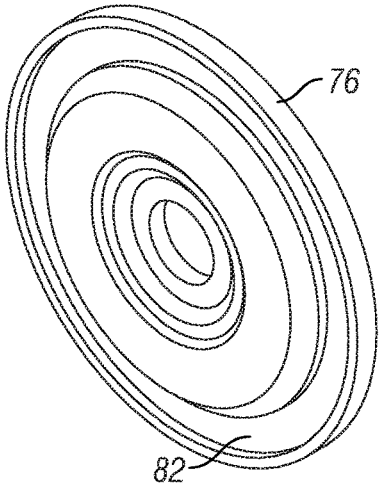
FIG. 54 is an upper right front perspective view of the lower retaining disk.
Figure 55:
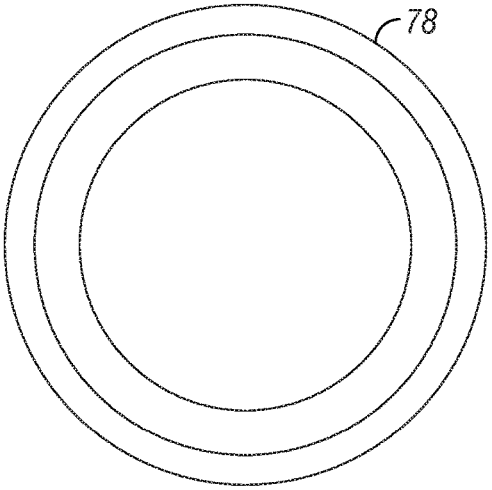
FIG. 55 is a front elevational view of the upper retaining disk.
Figure 56:
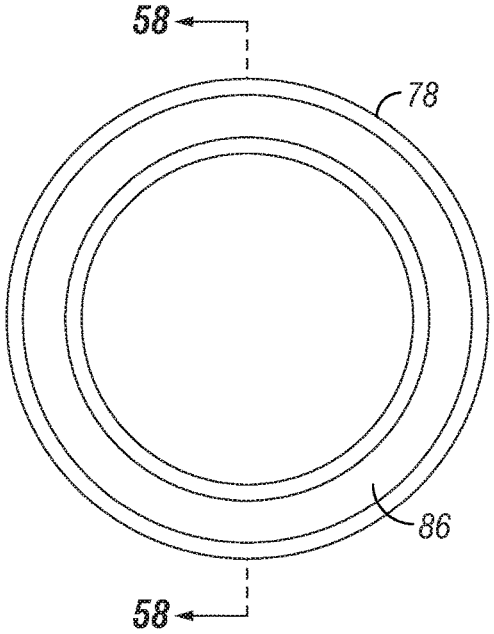
FIG. 56 is a rear elevational view of the upper retaining disk.
Figure 57:
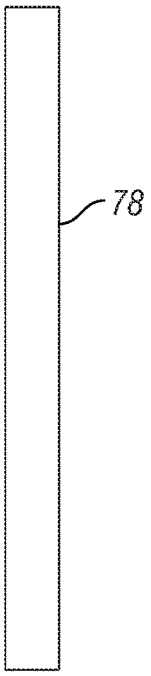
FIG. 57 is side elevational view of the upper retaining disk.
Figure 58:
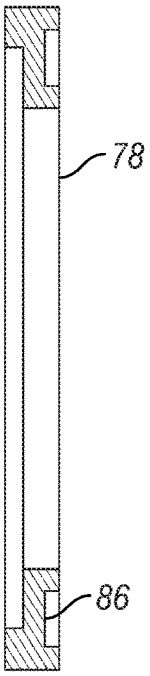
FIG. 58 is a sectional view of the upper retaining disk taken along line 58-58 of FIG. 56.
Figure 59:
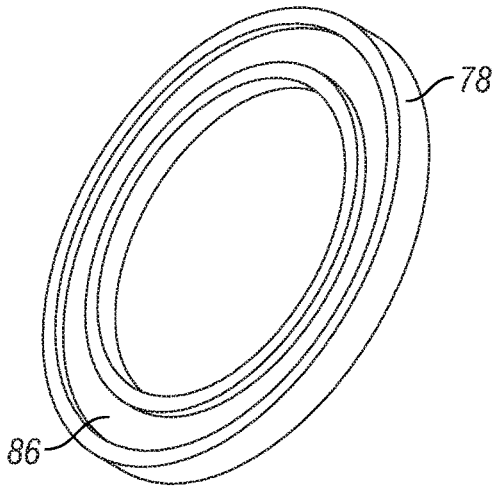
FIG. 59 is a lower right rear perspective view of the upper retaining disk.
Figure 60:
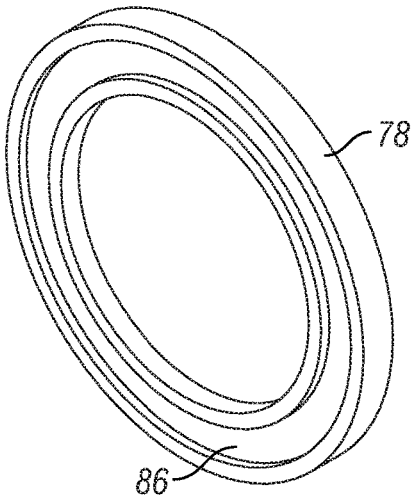
FIG. 60 is an upper right rear perspective view of the upper retaining disk.

As shown in FIGS. 5 and 10, the plunger 26 is mounted for reciprocal axial movement to produce a vibrating effect perceptible to the pedestrian. To that end, an electromagnet assembly 90 is included. The permanent magnet 92 is supported on the stem 46 under a shoulder 94 (FIGS. 7, 44, & 48). An O-ring 96 is disposed between the bottom of the magnet 92 and the groove 98 (FIGS. 50 and 52) on the front of the inner retaining disk 76. The coil 102 is fixed between the back of the flange 60 and the inner edge of the outer retaining disk 78. Thus, the plunger 26 and inner retaining disk 76 will move when the coil 102 is energized. The uppermost point of travel is when the inner spring 72 reaches maximum compression; the upper retaining ring 78 is fixed relative to the housing 12. The lower most point of travel occurs with the detents 58 abut the bottom of the detent receiving notches 62 compressing the upper spring 74. Of course, during normal operation as the plunger reciprocates, the bidirectional travel does not reach these maximum structural limits.

Now it will be apparent that the spring assembly 70 supports the plunger 26 for axial reciprocal movement bidirectionally from a neutral position inwardly toward the housing 12 and from the neutral position outwardly from the housing. The outer spring 74 generally is captured between the fixed housing 12 and the moving plunger head 36, and the inner spring 72 is captured between the housing and the free end 50 of the stem 46. When the plunger 26 moves outwardly, the inner spring 72 is compressed, creating a biasing force in the opposite or inward direction. When the plunger 26 moves inwardly, the outer spring 74 is compressed, creating a biasing force in the opposite outwardly direction. Ideally, the outwardly biasing force of the outer spring 74 is about equal to the inwardly biasing force of the inner spring 72. This balances the plunger 26 in a neutral position between its uppermost and lowermost points. At neutral buoyancy, the plunger/arrow location or orientation is locked into position.

As mentioned previously, a piezo assembly is a preferred mechanism for registering an inward movement of the plunger 26 when pressed by a pedestrian and communicating this event to the signal control assembly. The preferred embodiment of the present pushbutton station 10 includes a switch for activating the signal control assembly in response to pedestrian input, and a preferred switch device is the piezo assembly designated generally at 110 seen best in FIG. 10. In order to reduce the likelihood that hard impacts will damage the piezo element, the preferred assembly 110 provides for offset and indirect actuation of the piezo element 112. This offset piezo actuation design accommodates assembly tolerances as well as protecting the piezo element. Additionally, because the movement of the plunger is amplified, the pushbutton is more sensitive to the pedestrian's touch.

Figure 4:
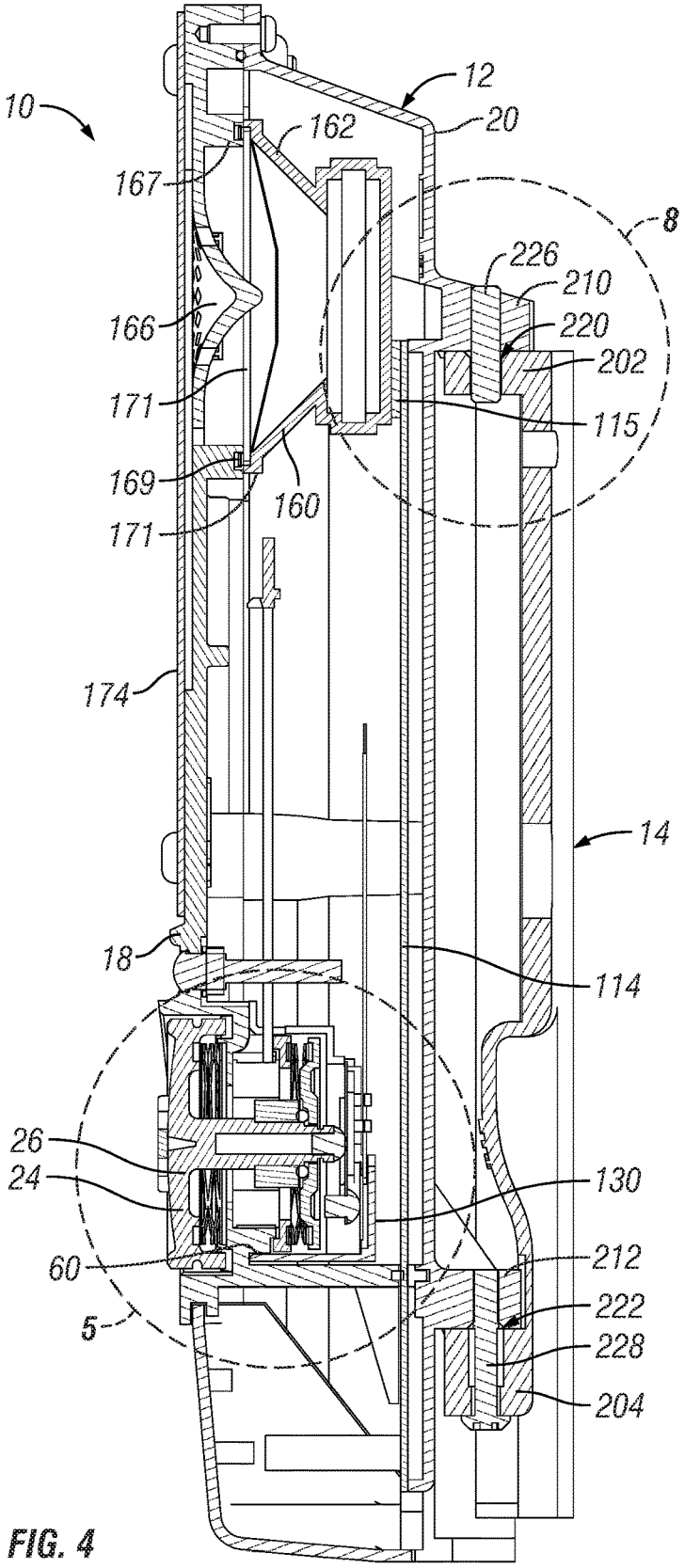
FIG. 4 is a longitudinal sectional view of the pushbutton station taken along line 4-4 of FIG. 2.
Figure 8:
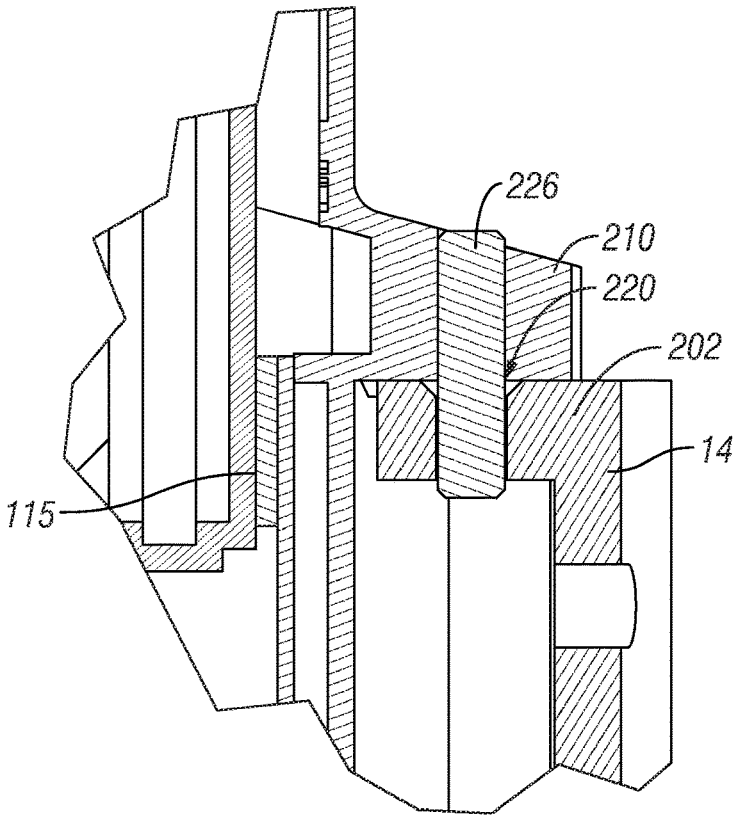
FIG. 8 is an enlarged view of the circular area designated as "8" in FIG. 4.
Figure 80A:
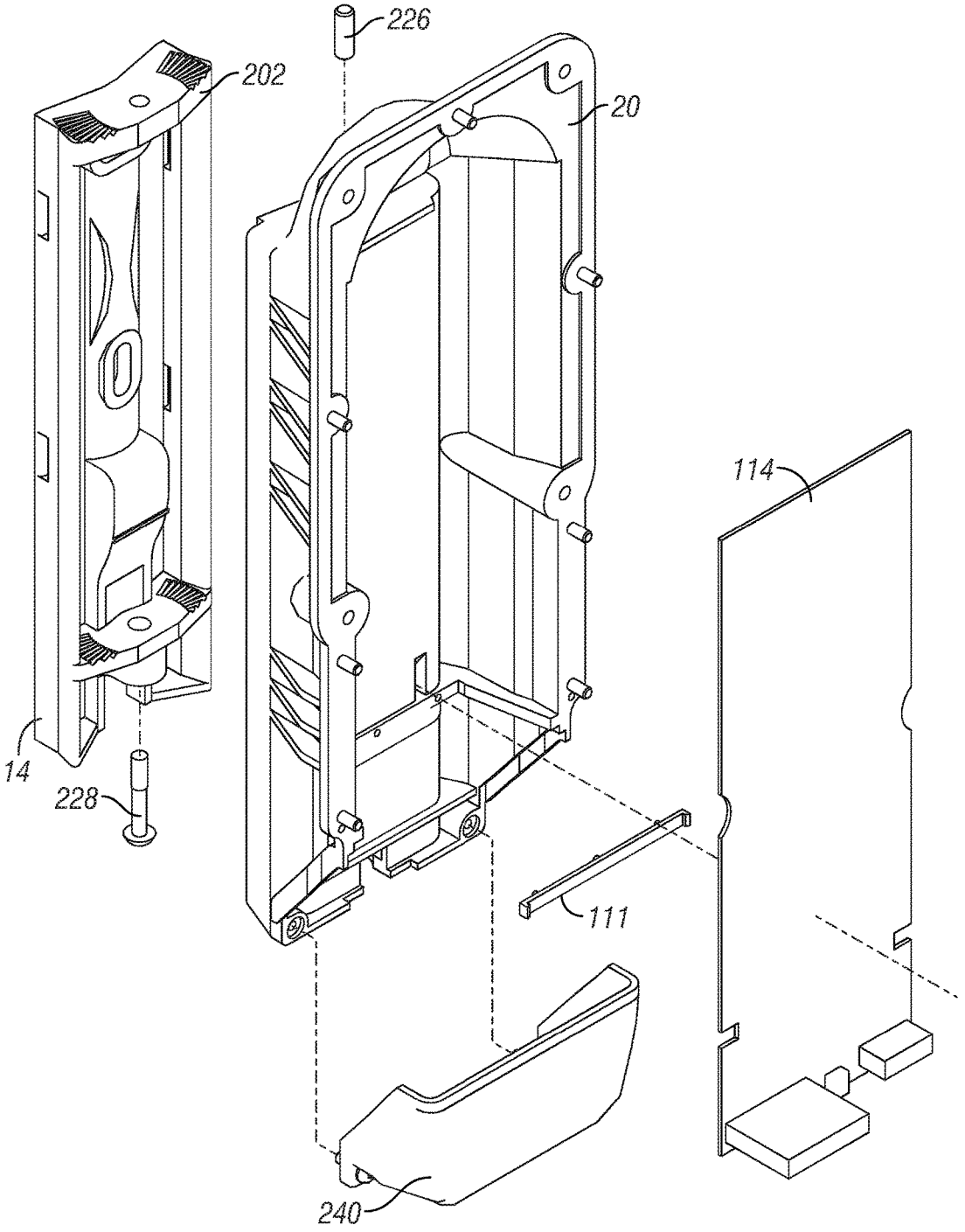
FIGS. 80A-80C are sequential parts of an exploded perspective view of the assembled pushbutton station.
Figure 80B:
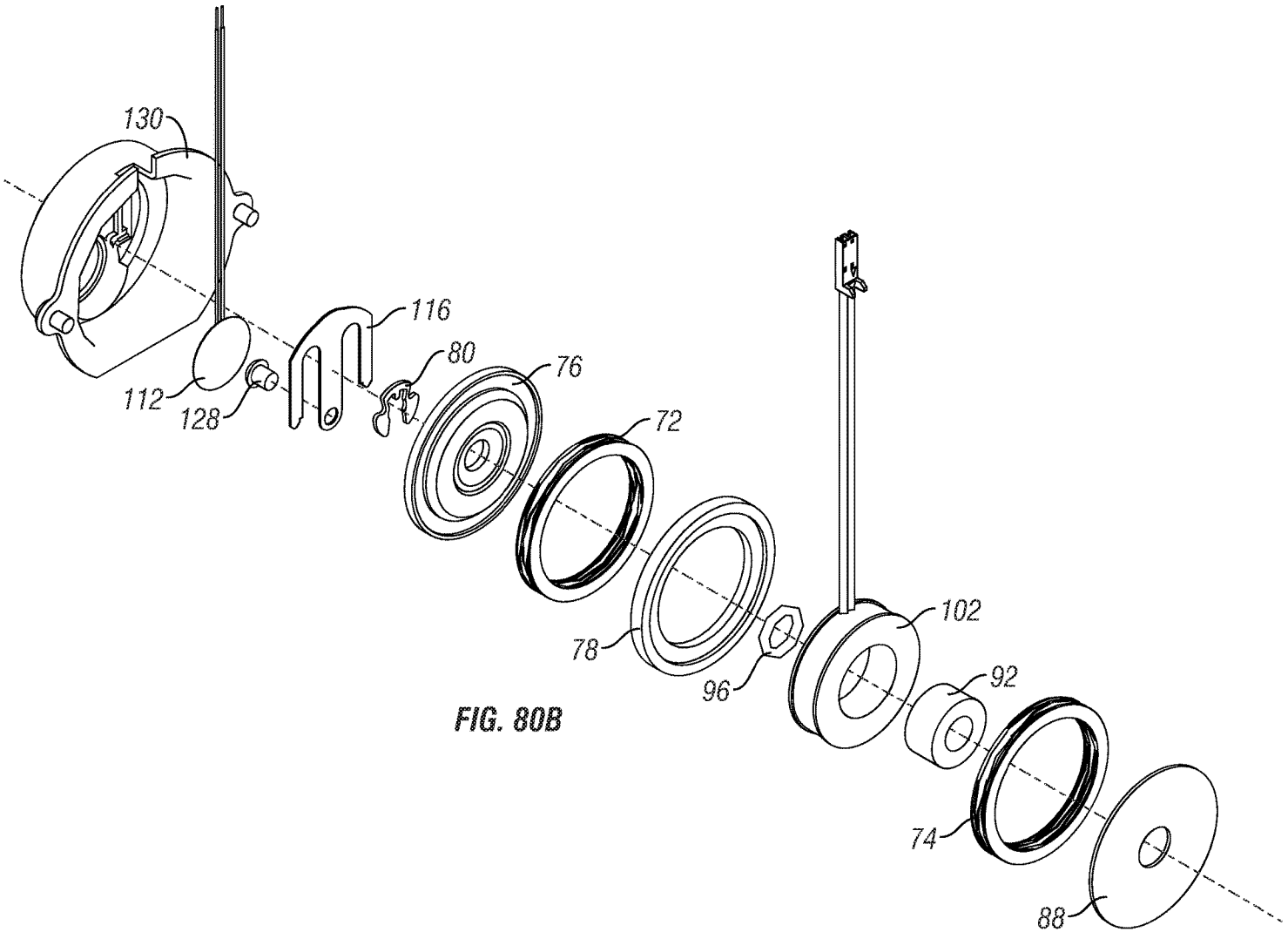
Figure 80C:
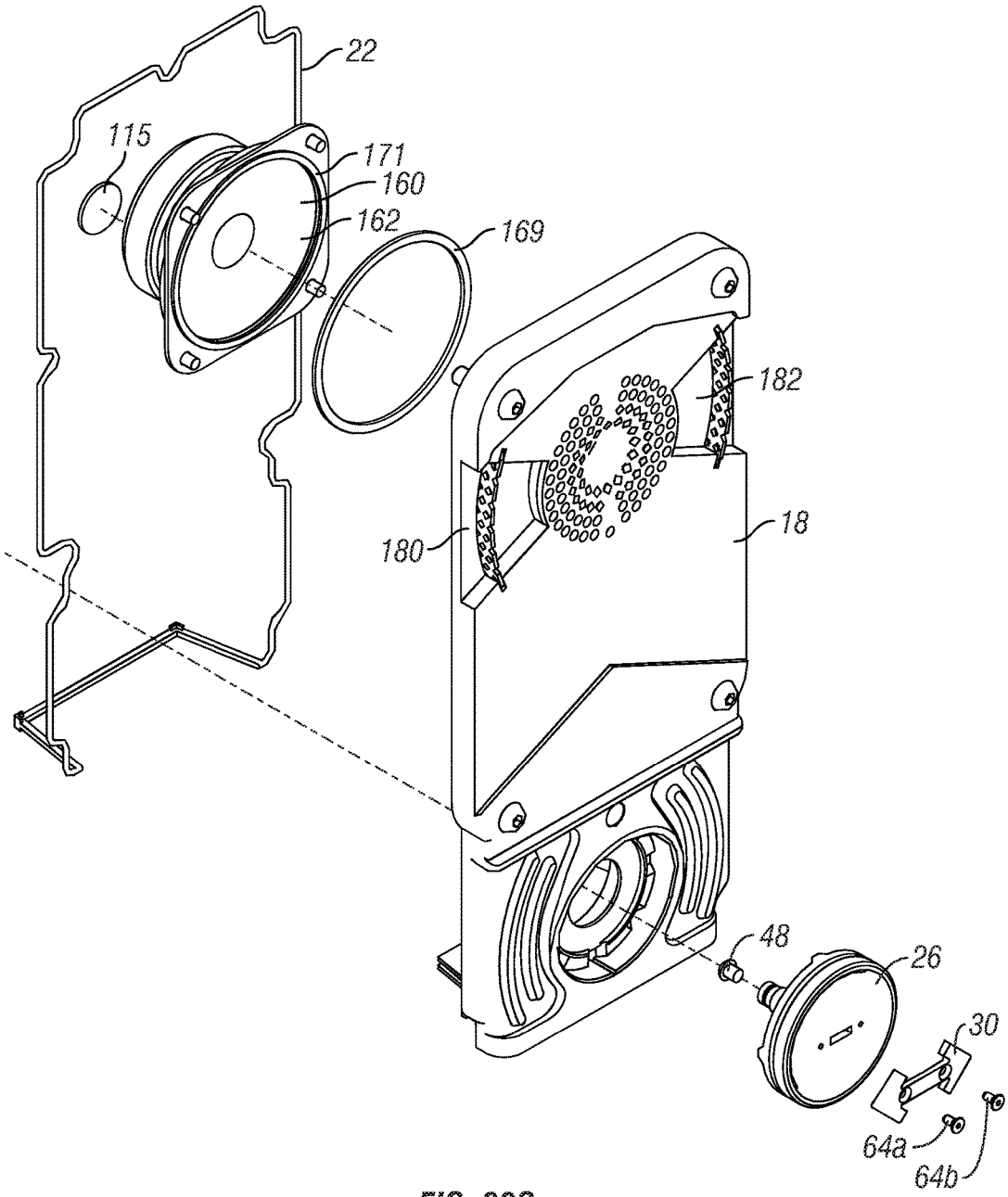

As seen in FIG. 10, the piezo element or bender 112 is supported in the housing 12 and positioned a distance laterally from the stem bumper 48. The piezo bender 112 is operatively connected to the signal control assembly, which includes a printed circuit board 114 ("PCB") mounted inside the housing 12. (The wiring is omitted to simplify the illustration.) The PCB 114 may be arranged vertically in the housing 12. At the bottom, the PCB is secured between a horizontal seal 111 and the main seal 22, as best shown in FIGS. 5, 10 and 80A. The top of the PCB is secured between the back of the speaker 162 and the housing 12, with a foam disk 115 compressed between the back of the speaker 162 and the front of the PCB, as shown in FIGS. 4, 8 and 80C.

Inward movement of the stem bumper 48 is transferred to the piezo bender 110 by a pressure transfer member 116 that includes an elongate spring actuator 118. In its preferred form, the spring actuator member has a first end 120 and a second end 122. The preferred pressure transfer member 116 is shown in more detail in FIGS. 61-63. The spring actuator 118 has a stem bumper contact point 124 (FIGS. 61 & 63) that is axially aligned with and supported a distance from the stem bumper 48 so that axial movement of the plunger 26 into the engaged position causes the stem bumper to press on the stem bumper contact point 124, as shown in FIG. 10.

An offset bumper 128 (FIG. 10) is supported on the second end 122 of the spring actuator 118 so that it is displaced a distance laterally from the stem bumper contact point 124. The pressure transfer member 116 is supported in the housing 12 so that the offset bumper 128 is axially aligned with and supported a distance from the piezo bender 112. Due to the shape and flexibility of the spring actuator 118, pressure from the stem bumper 48 on the stem bumper contact point 124 is transferred to the offset bumper 128, which in turn presses on and actuates the piezo bender 112. More preferably, the spring actuator 118 is configured so that, when the plunger 26 is moved to the engaged position, the pressure exerted by the stem bumper 48 on the stem bumper contact point 124 will cause the offset bumper 128 to move axially a greater distance than the stem bumper 48 moved the stem bumper contact point 124. Thus, there is no direct pressure on the piezo bender 112, yet pressure applied to the plunger 26 transferred to the central stem bumper 48 creates an amplified but indirect movement of the offset bumper 128.

One suitable way to support the pressure transfer member 116 in the housing is to mount the member in a strain relief cup or cover that also supports the piezo element 112. A preferred strain relief cover is shown in FIGS. 64-79 and designated generally by the reference number 130. The strain relief cover 130 may be generally cylindrical with ears 132*a* and 132*b* for attachment to the inside of the housing 12. At the bottom rear of the cover is a piezo recess 132 circumscribed by an annular piezo support shoulder 138 configured to receive the piezo bender element 112. Strain relief tabs 134*a* and 134*b* on the back of the cover guide the wires (not shown) through the wiring notch 136 at the top of the cover 130.

Figure 63:
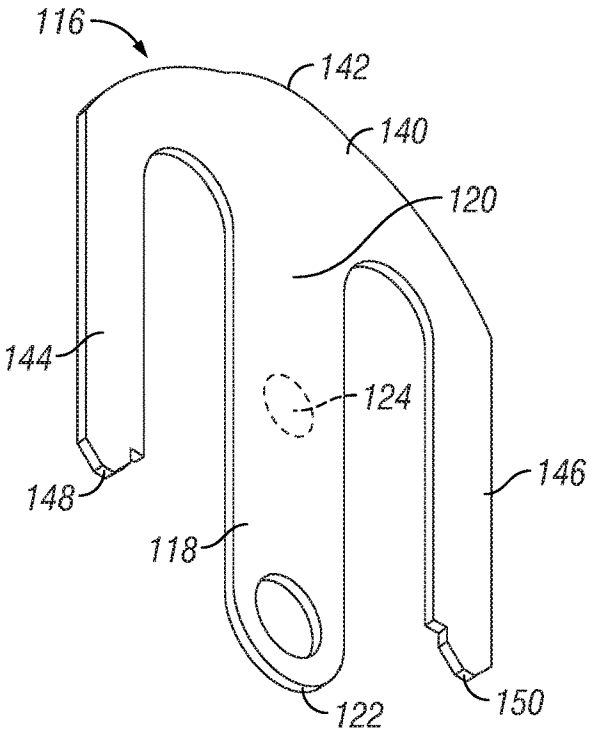
FIG. 63 is a lower right frontal perspective view of the spring actuator.
Figure 62:
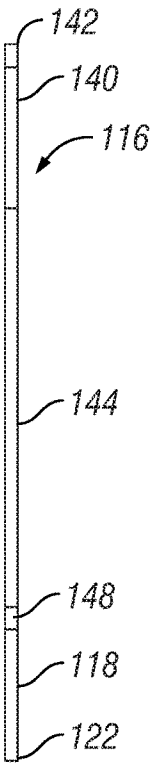
FIG. 62 is a right side elevational view of the spring actuator, both sides being identical.
Figure 61:
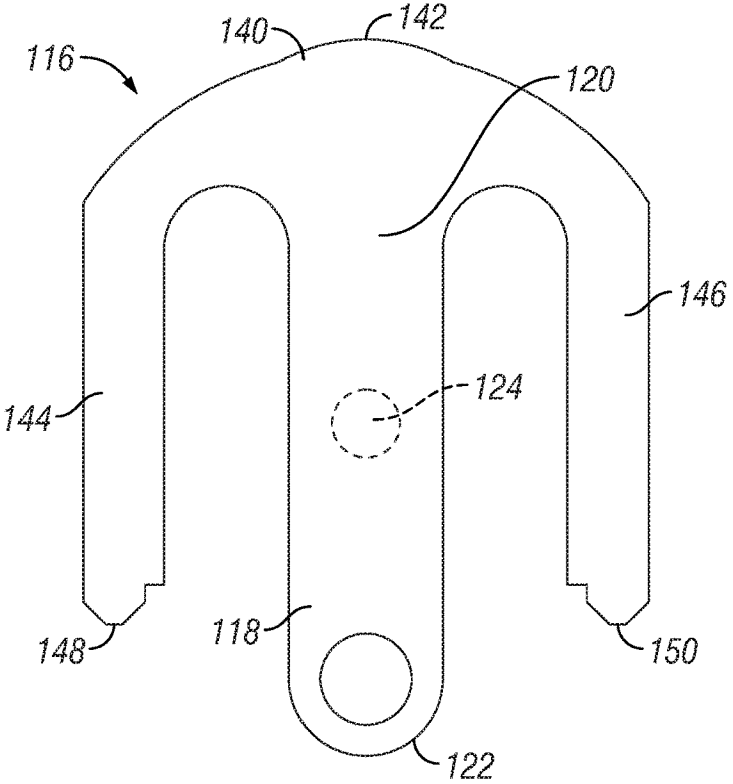
FIG. 61 is a front elevational view of the spring actuator, the rear view being identical thereto.
Figure 64:
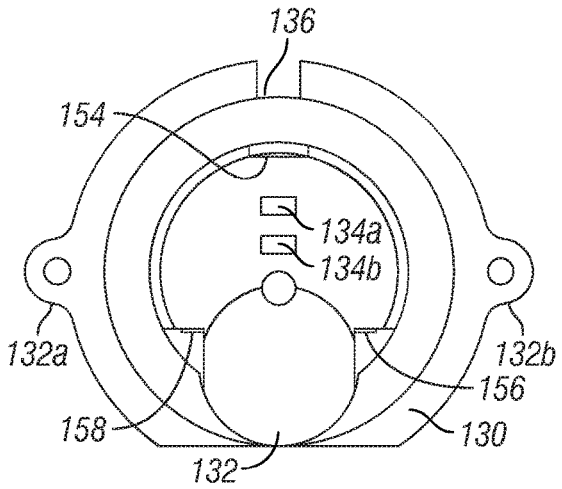
FIG. 64 is a rear elevational view of the strain relief cover.
Figure 65:
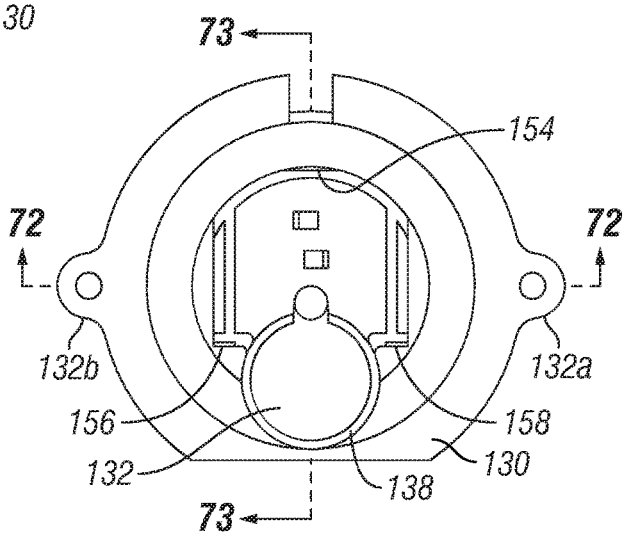
FIG. 65 is a front elevational view of the strain relief cover.
Figure 66:
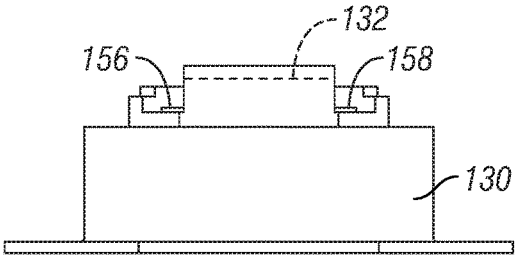
FIG. 66 is a bottom elevational view of the strain relief cover.
Figure 67:
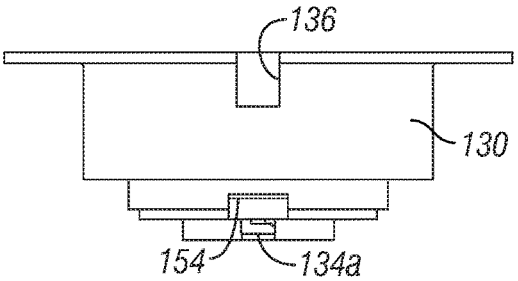
FIG. 67 is a plan view of the strain relief cover.
Figure 68:
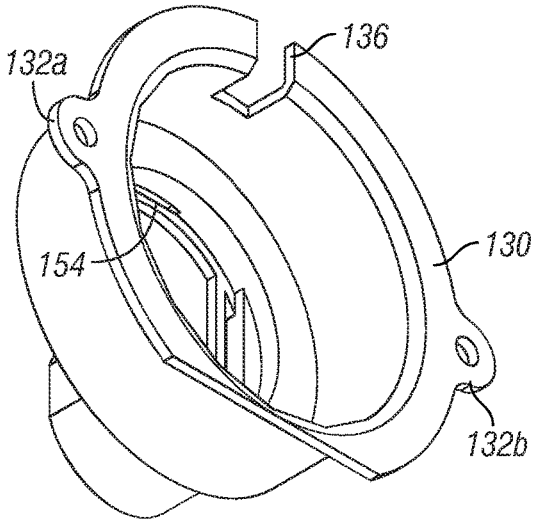
FIG. 68 is a left lower front perspective view of the strain relief cover.
Figure 69:
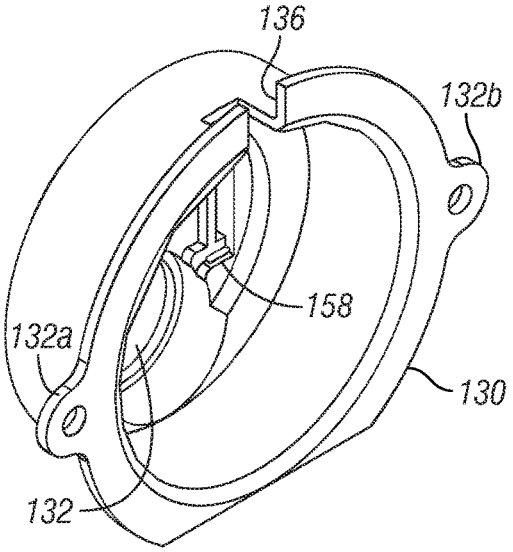
FIG. 69 is a left upper front perspective view of the strain relief cover.
Figure 70:
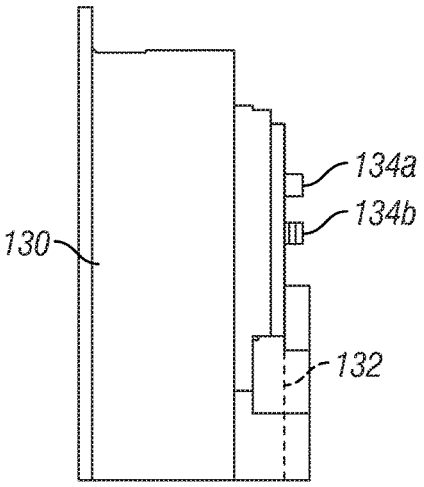
FIG. 70 is a right side elevational view of the strain relief cover.
Figure 71:
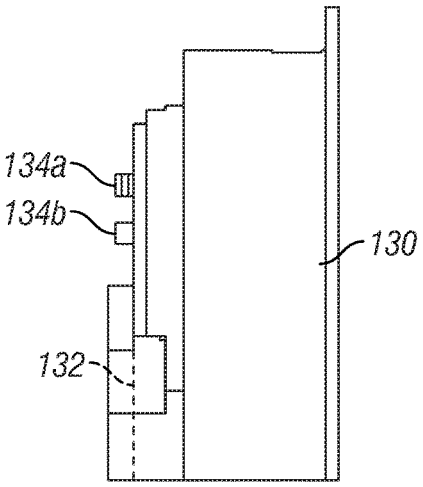
FIG. 71 is a left side elevational view of the strain relief cover.
Figure 72:
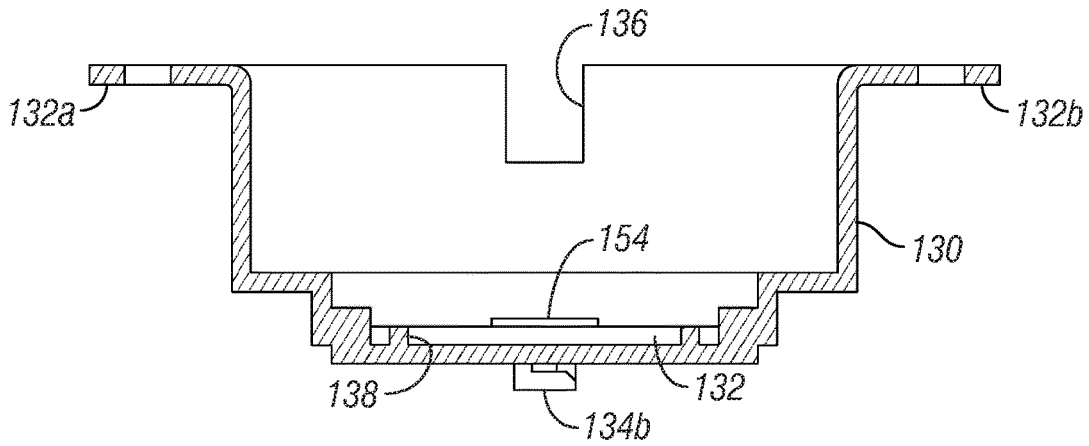
FIG. 72 is a sectional view of the strain relief cover taken along the line 72-72 in FIG. 65.
Figure 73:
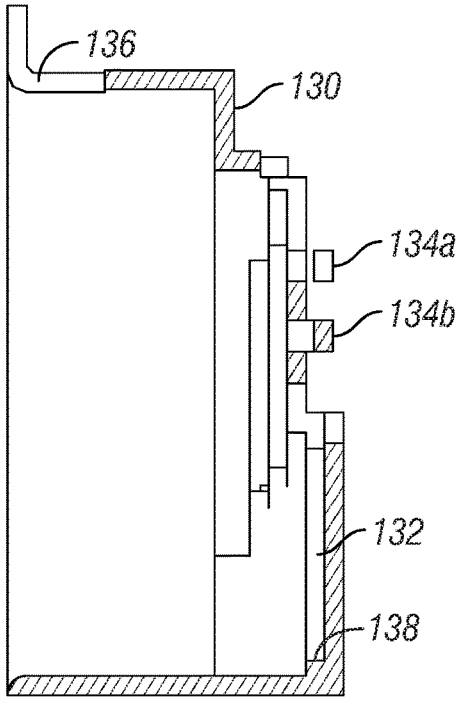
FIG. 73 is a sectional view of the strain relief cover taken along the line 73-73 in FIG. 65.
Figure 74:
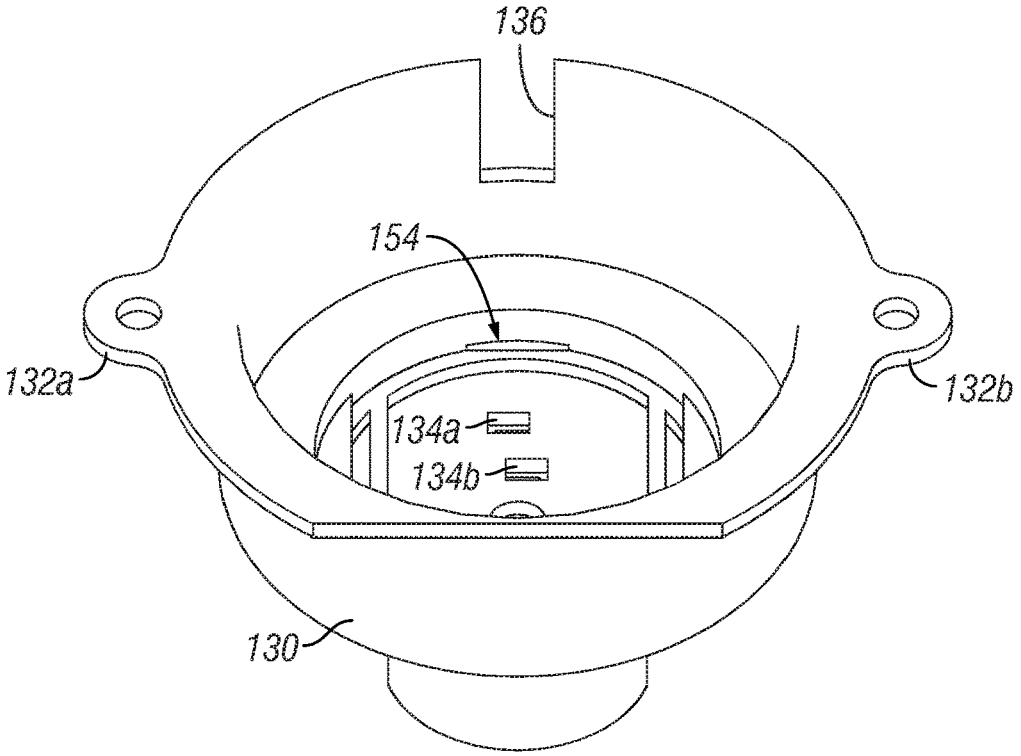
FIG. 74 is a bottom front perspective view of the strain relief cover.
Figure 75:
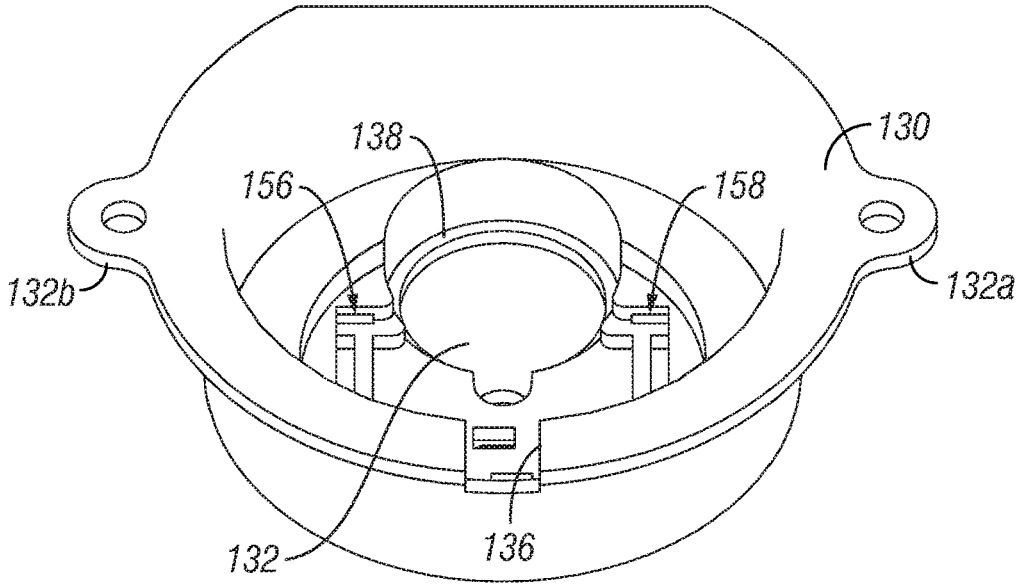
FIG. 75 is a top front perspective view of the strain relief cover.
Figure 77:
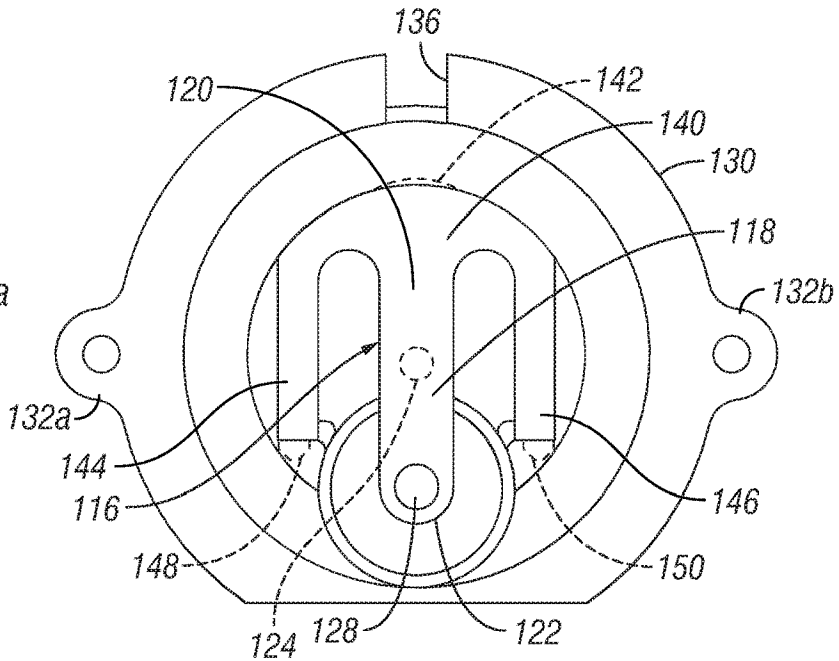
FIG. 77 is front (inside) elevational view of the strain relief cover with the spring actuator installed.
Figure 76:
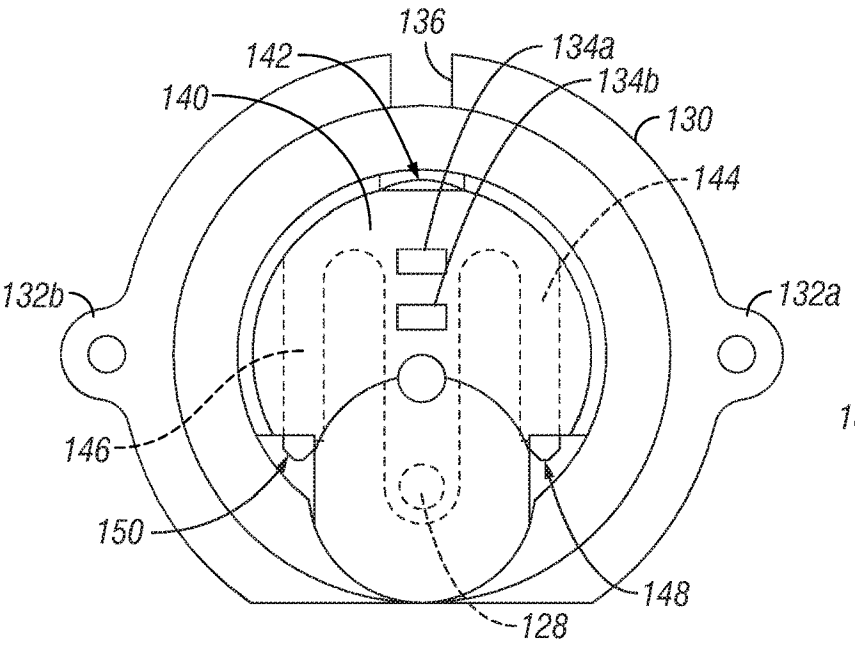
FIG. 76 is a rear elevational view of the strain relief cover with the spring actuator installed.
Figure 78:
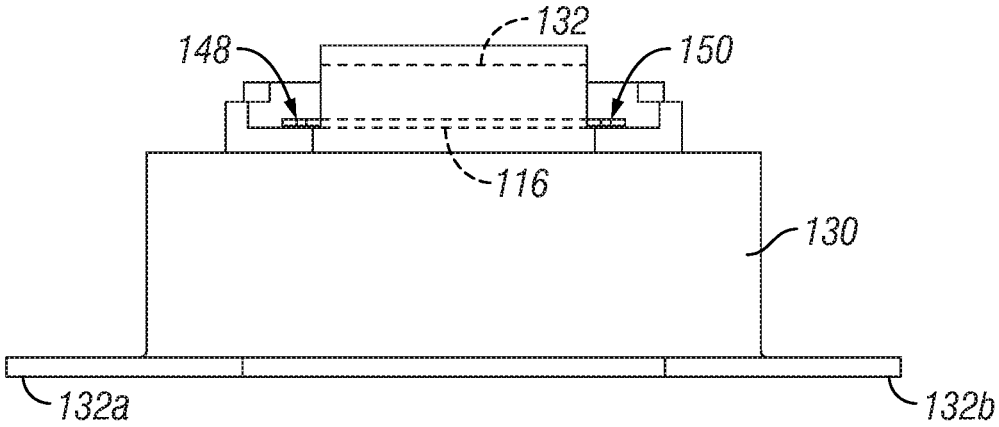
FIG. 78 is a bottom elevational view of the strain relief cover with the spring actuator installed.
Figure 79:
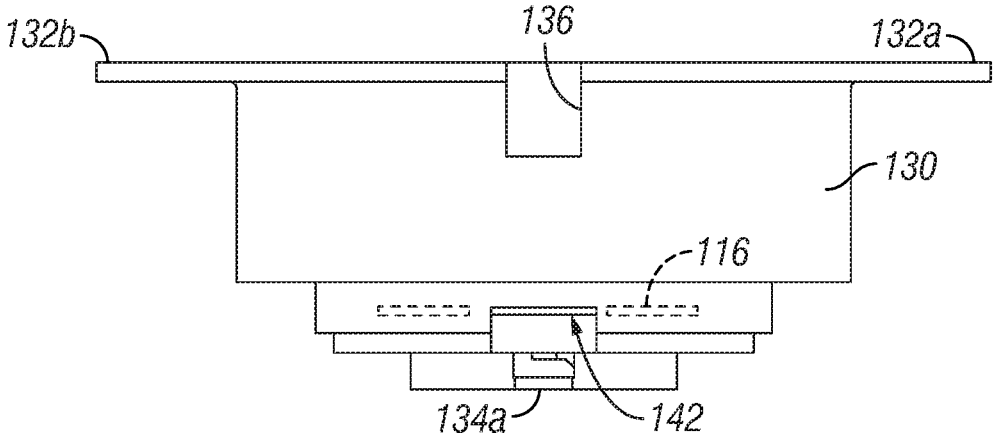
FIG. 79 is a plan view of the strain relief cover with the spring actuator installed.

With continued reference to FIGS. 61-63, to generally conform to the shape of the inside of the cover 130, the pressure transfer member 116 may be provided with a curved base or spine 140 curving over the first end 118 of the member 116 with an outwardly extending mounting tab 142. Thus, the spring actuator 118 projects transversely from the curved spine 140. Additionally, the pressure transfer member 116 may include first and second side projections 144 and 146, one extending from the spine 140 on each side of the spring actuator 118 and being generally parallel thereto. Thus, the spring actuator 118 and the side projections 144 and 146 form three finger-like projections on the spine 140. Mounting tabs 148 and 150 are formed on the ends of the side projections 144 and 146.

The three tabs 142, 148, and 150 (FIGS. 61-63) are used to secure the pressure transfer member 116 inside the strain relief cover 130. A slot 154 formed in the top of cover 130 receives the mounting tab 142 on outside edge of the spine 140, as best seen in FIGS. 64, 67, 68,72, and 74. Slots 156 and 158 in the sides of the cover 130 receive the mounting tabs 148 and 150, respectively, as seen in FIGS. 64-66, 69, and 75. In this way, the spring actuator 118 is suspended between the stem bumper 48 and the piezo bender 112 as best seen in FIG. 10.

Now it will be appreciated that the plunger 26, the housing 12, and the spring assembly 70 are cooperatively configured to limit the inward travel of the plunger when reciprocating in response to the electromagnet 90 to a maximum reciprocating distance that is less than the distance that would result in a damaging impact on the piezo element, that is, the maximum impact distance. Preferably, the maximum reciprocating distance is less than about 0.005 inch and the maximum impact distance is greater than about 0.015 inch. More preferably; the maximum reciprocating distance is between about 0.002 inch and about 0.004 inch and the maximum impact distance is about 0.020 inch.

In some instances, the signal control assembly will respond to the pedestrian's pressing of the pushbutton 26 by causing audible tones or verbal messages to be output by the station 10. Thus, a speaker 160 is provided in the housing 12, as seen in FIGS. 4 and 80C. The diaphragm 162 (FIG. 4) of the speaker 160 is positioned behind a perforated concave central area 166 in the upper portion of the housing front 18. The back surface of the housing front 18, seen in FIG. 22, has a circular ring 167 with a groove to receive a watertight seal 169 that seals to the peripheral edge 171 on the diaphragm 162.

The front 18 of the housing 12 may include a larger area 168 surrounding the perforated central area 166 that is setback slightly from the front surface 170 of the housing, as seen in FIGS. 19-24. This setback area 168 provides a recess for receiving a cover plate such as the sign plate 174 (FIGS. 1&2). The distance in front of the surface of the setback region 168 behind the sign plate 174 forming a resonance chamber therebetween.

The front 18 of the housing 12 may further define more deeply setback bilateral side vent recesses 180 and 182, one on each side of the perforated central area 166 and continuous therewith. These side vents 180 and 182 are configured to vent sound generated by the speaker 160 as it exits the central perforated area 166. While the fan shape shown is preferred, the recesses 180 and 182 may be shaped differently. In most instances, protective sound screens or grills 184 and 186 are mounted in the recesses 180 and 182. When necessary, either of these recesses 180, 182 can be dampened or baffled to reduce or block sound emission. For example, a baffle (not shown) such as a foam wedge or other insert may be inserted in one or both of the recesses 180, 182 between the housing front 18 and the sign plate 174.

Having described the housing 12 and its components, the articulated mounting assembly for the pushbutton station 10 will be explained. The rear mounting system of the present invention supports the housing 12 for pivotal movement relative to the rear mount 14. In the most preferred embodiment, the pivotal connection allows for a full thirty degrees (30°) of articulation about the vertical axis. From the center position, the housing 12 can articulate fifteen degrees (15°) to the left or the right. This mounting system allows for a more accurate installation of the unit and safer pedestrian use because it ensures that the station 10 can be parallel to the walkway.

In the preferred embodiment, the mounting assembly is sold as a component of the station 10. However, it will be understood that the articulating mount assembly could be sold separately. The mounting assembly comprises mounting plate, such as the rear mount 14, shown in detail in FIGS. 27-34. The rear mount 14 may have a curved or angled rear surface 190. In this way, the rear mount 14 can be secured to a flat surface, such as one of the sides of a multi-sided (polygonal) pole. Then, if the front of station 10 is not parallel to the cross walk, the housing 12 can be rotated slightly on the rear mount 14 until it is parallel. Additionally, the rear mount 14 is also provided with one or more slots, such as the upper and lower mounting slots 194 and 196, shown in FIGS. 27-30. These slots accommodate installation errors and facilitate simple but accurate positioning of the station 10. Even if the mounting bolts or other connectors (not shown) are incorrectly positioned or imperfectly aligned on the vertical support, the slots 194 and 196 allow for slight vertical and horizontal movement of the mounting plate.

Figure 9:
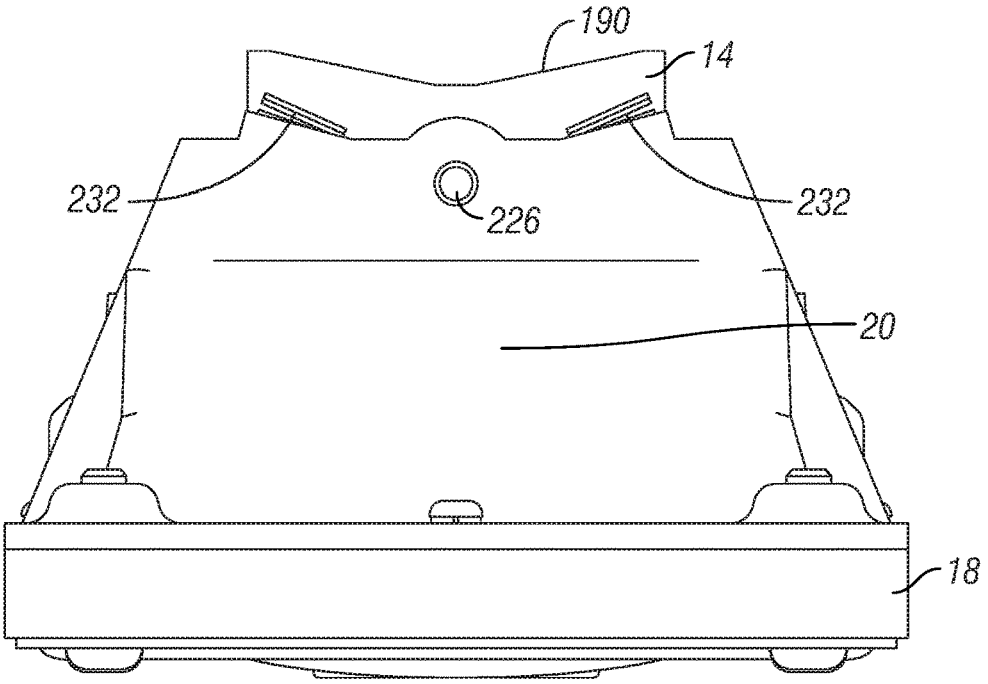
FIG. 9 is a plan view of the pushbutton station of FIG. 1.
Figure 14:
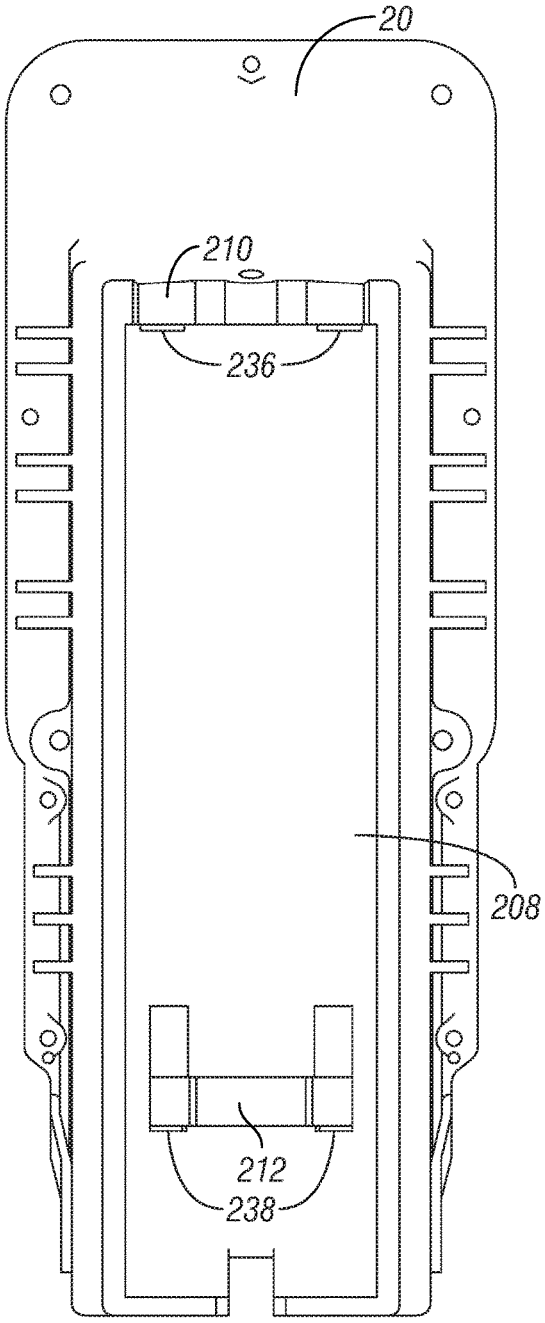
FIG. 14 is a rear elevational view of the casting back.
Figure 15:
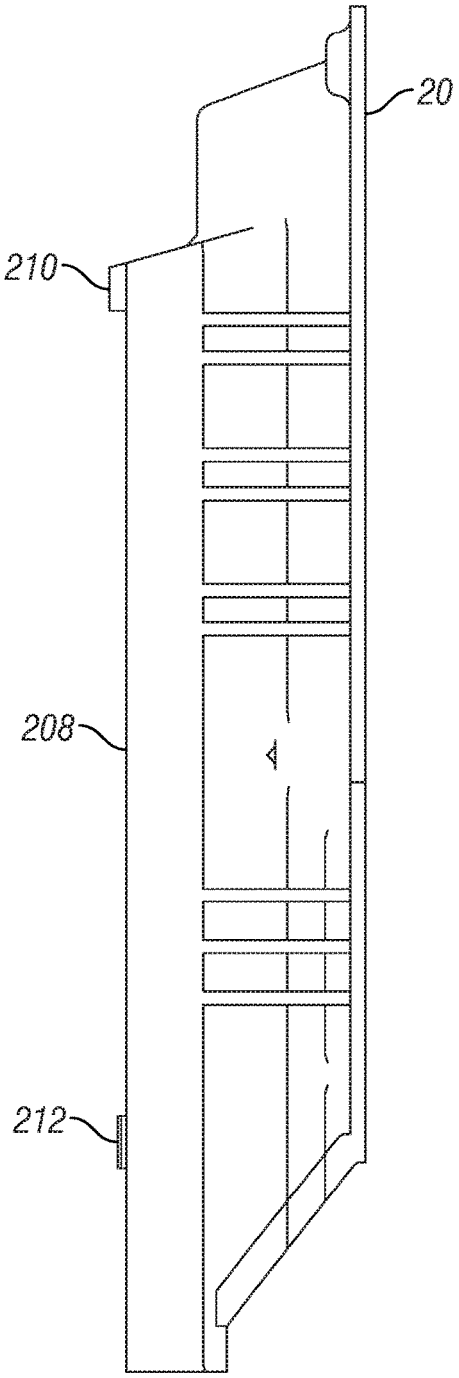
FIG. 15 is a left side elevational view of the casting back.
Figure 16:
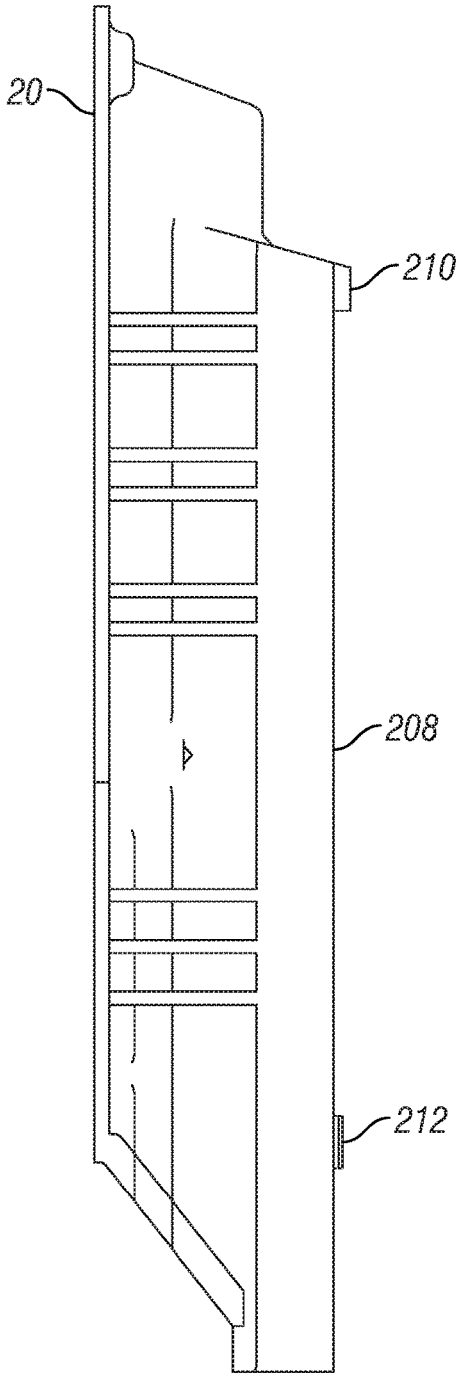
FIG. 16 is a right side elevational view of the casting back.
Figure 17:
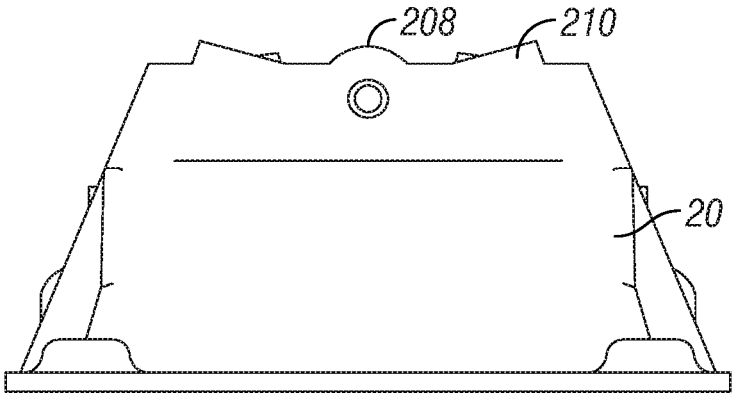
FIG. 17 is a plan view of the casting back.
Figure 18:
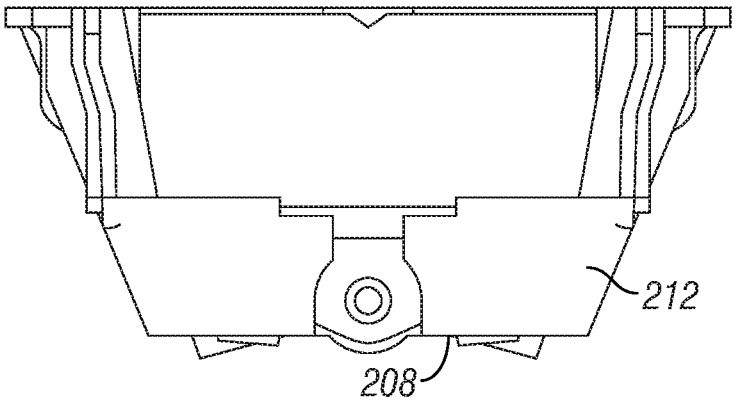
FIG. 18 is a bottom elevational view of the casting back.
Figure 27:
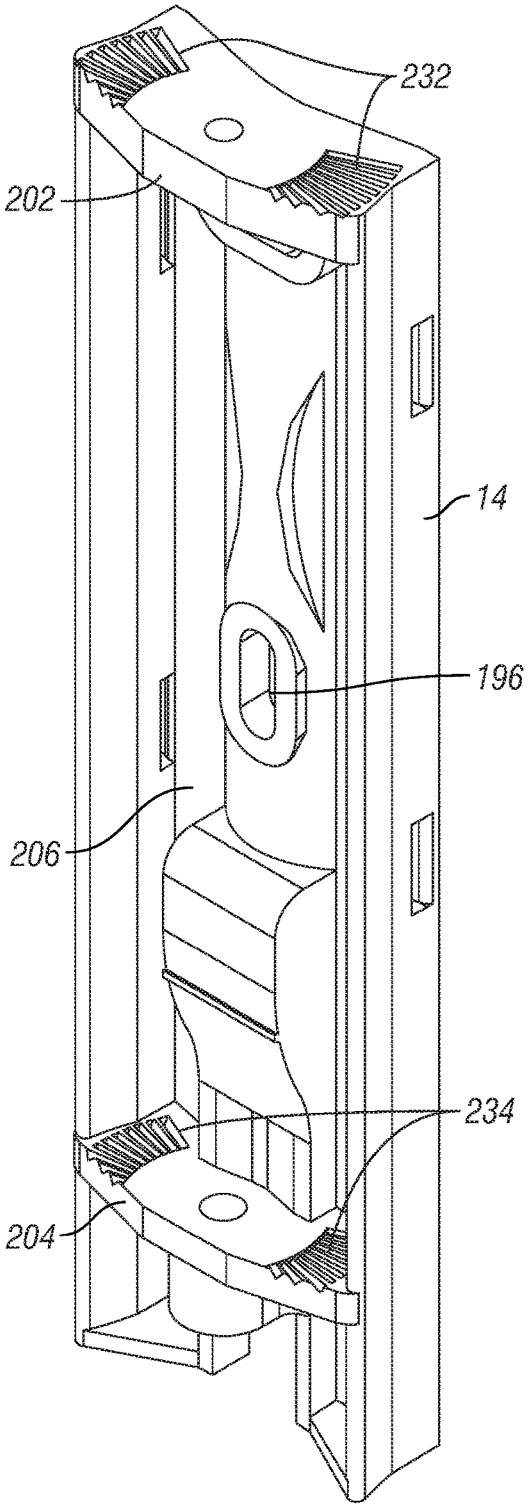
FIG. 27 is an upper right frontal perspective view of the casting rear mount.
Figure 28:
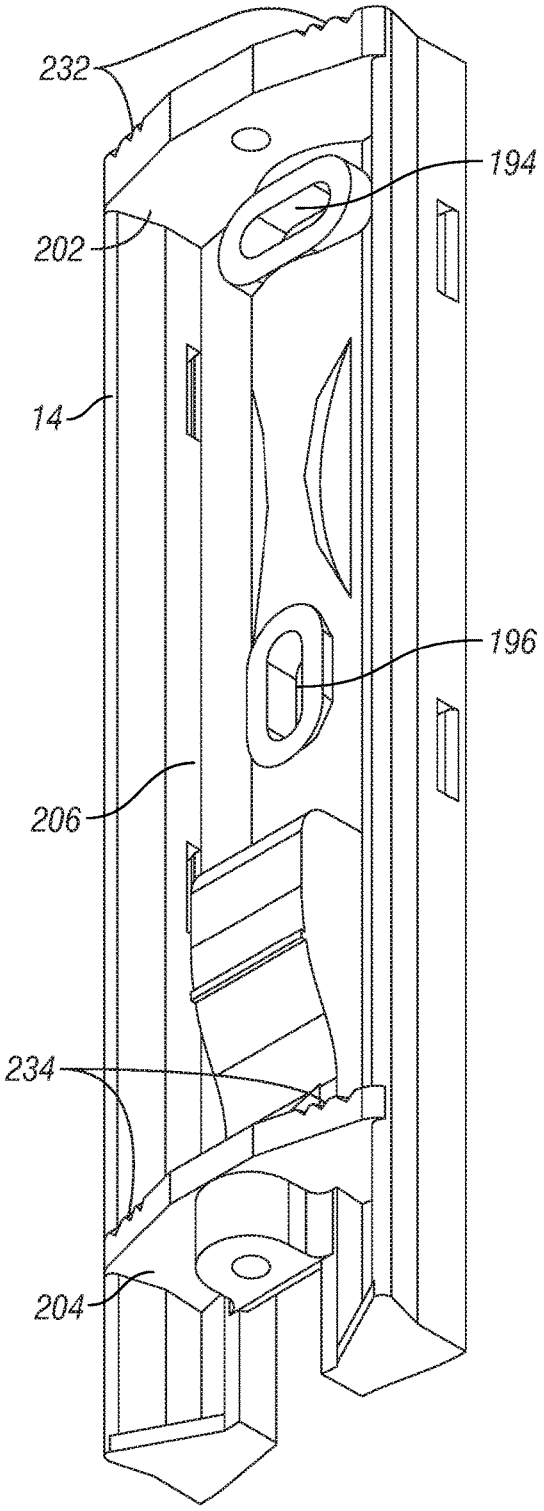
FIG. 28 is a lower right frontal perspective view of the rear mount.
Figure 29:
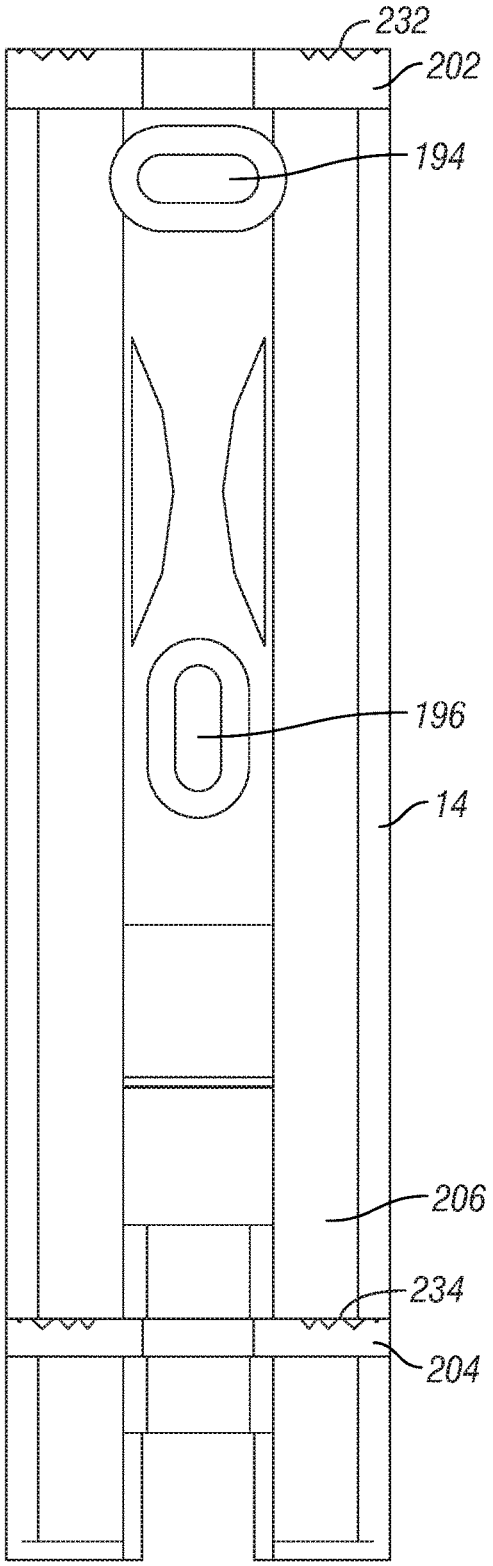
FIG. 29 is a front elevational view of the rear mount.
Figure 30:
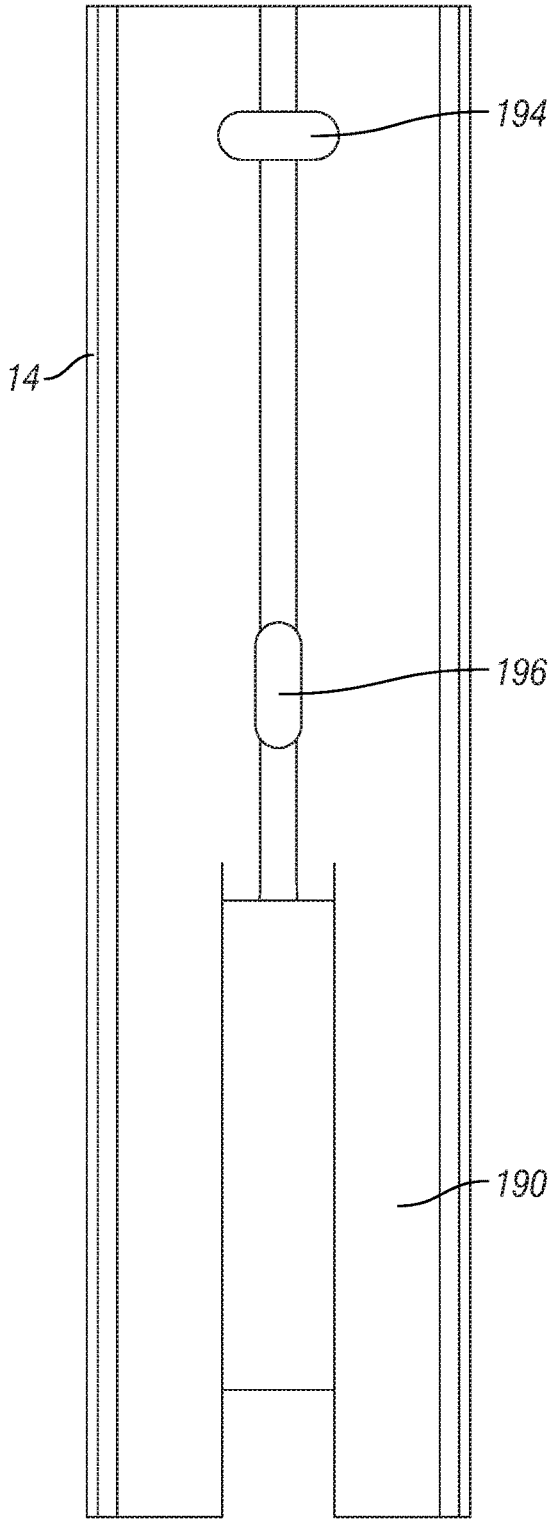
FIG. 30 is a rear elevational view of the rear mount.
Figure 31:
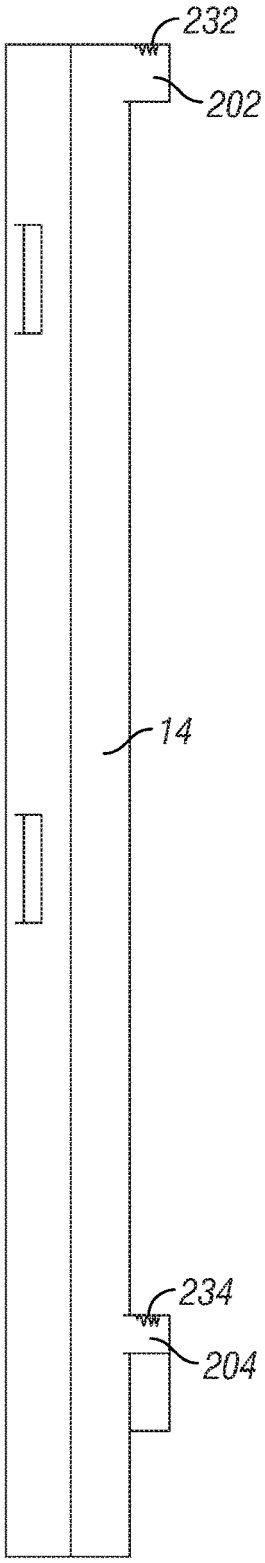
FIG. 31 is a left side elevational view of the rear mount.
Figure 32:
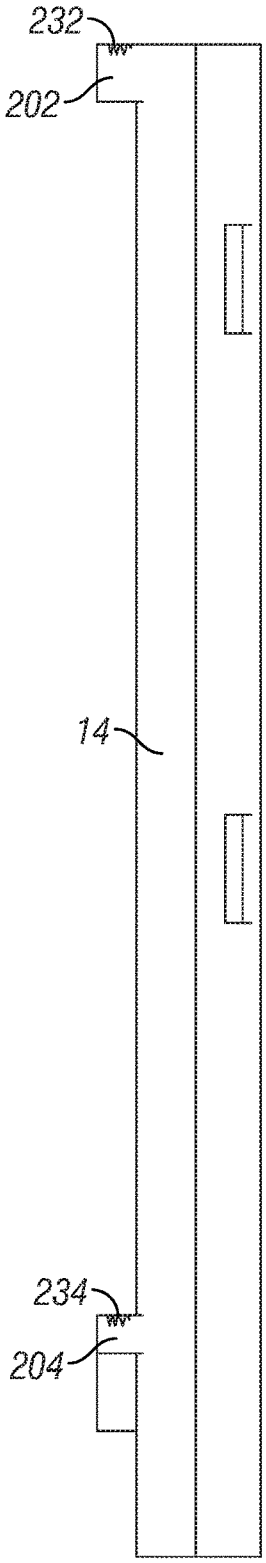
FIG. 32 is a right side elevational view of the rear mount.
Figure 33:
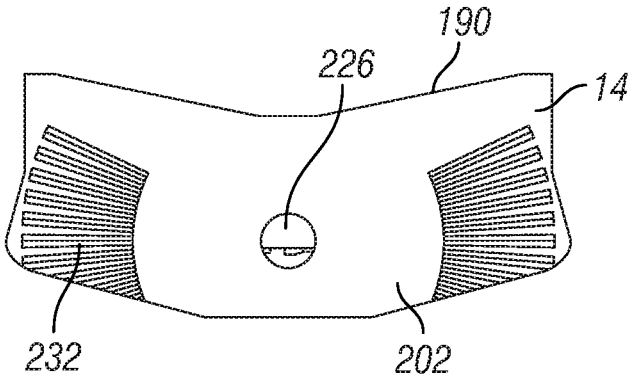
FIG. 33 is a plan view of the rear mount.
Figure 34:
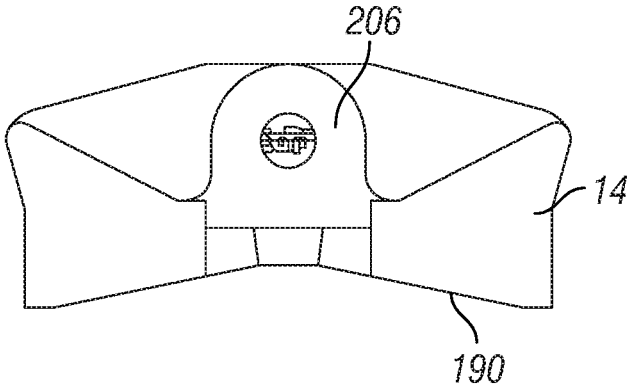
FIG. 34 is a bottom elevational view of the rear mount.
Figure 35:
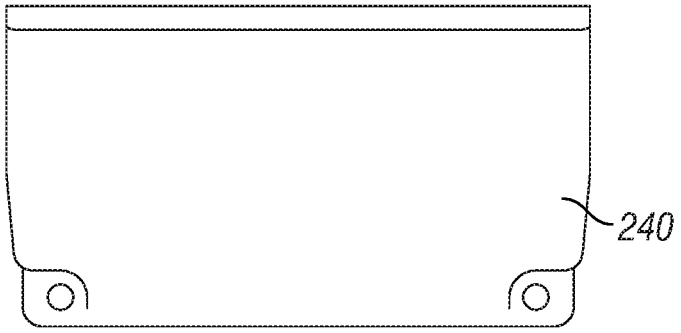
FIG. 35 is a front elevational view of the casting front cover or user access panel.
Figure 36:
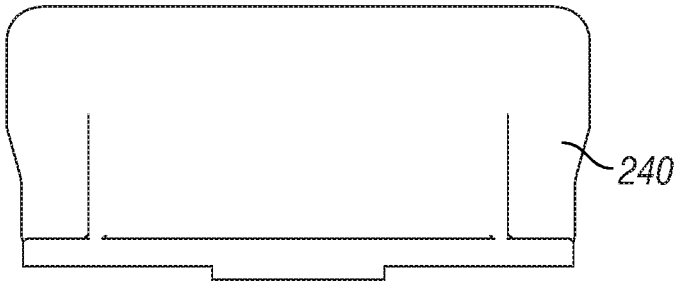
FIG. 36 is a bottom elevational view of the user access panel.
Figure 37:
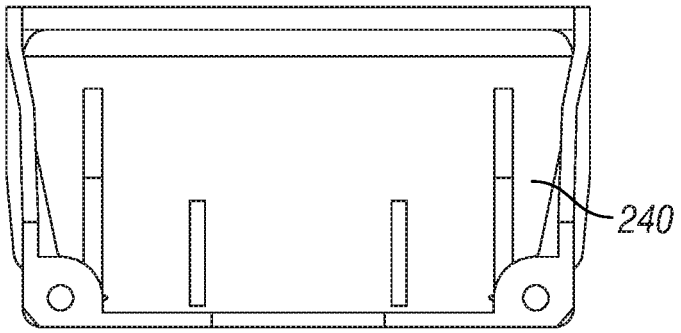
FIG. 37 is a rear elevational view of the user access panel.
Figure 39:
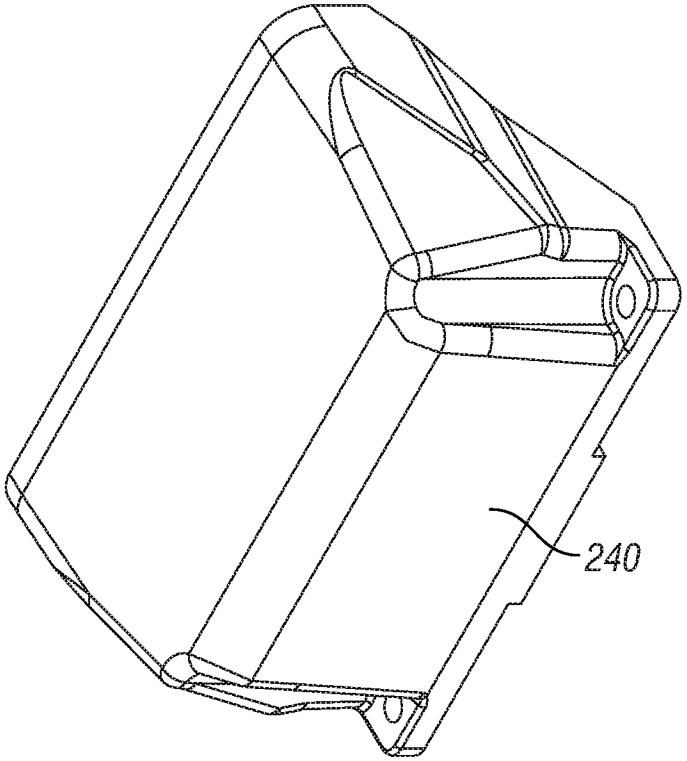
FIG. 39 is a lower right front perspective view of the user access panel.
Figure 38:
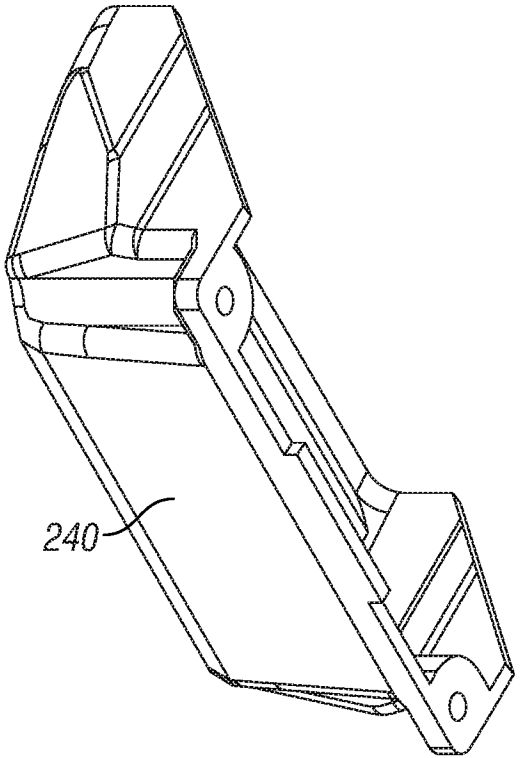
FIG. 38 is a lower right rear perspective view of the user access panel.
Figure 40:
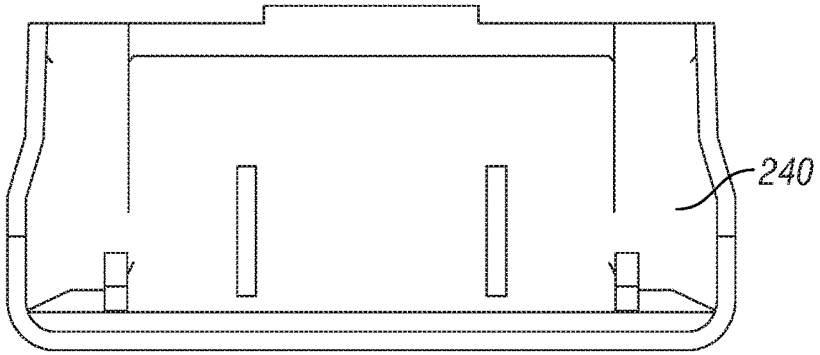
FIG. 40 is a plan view of the user access panel.
Figure 41:
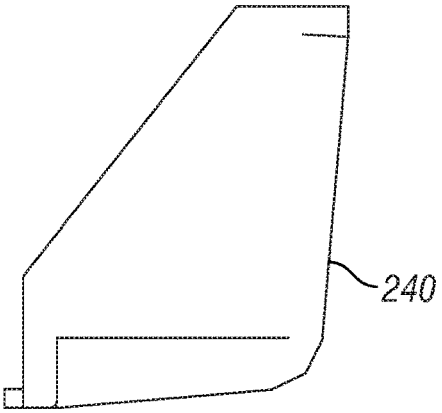
FIG. 41 is a left side elevational view of the user access panel.
Figure 42:
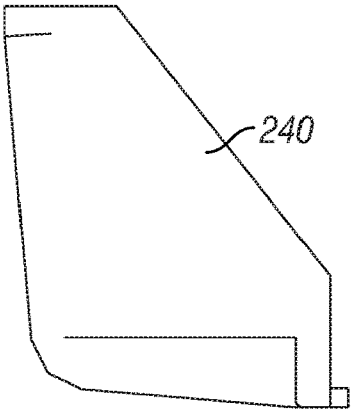
FIG. 42 is a right side elevational view of the user access panel.
Figure 43:
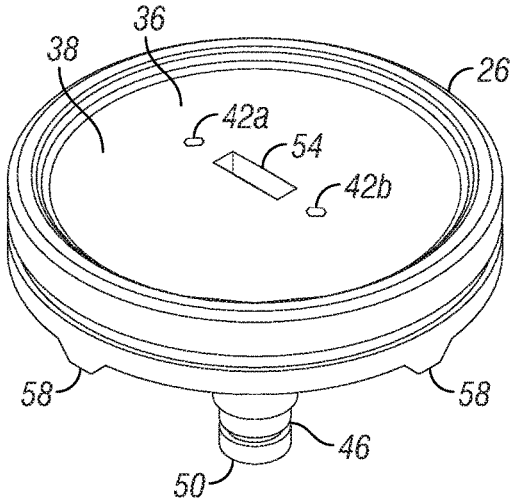
FIG. 43 is a front perspective view of the plunger.

The specific configuration of the pivotal connection between the housing 12 and the rear mount 14 may vary. In the preferred embodiment, there are upper and lower housing support shelves 202 and 204 extending forwardly from the front surface 206 of the rear mount 14. Vertical sidewalls 207*a* and 207*b* extend forwardly from the front surface 206 of the rear mount 14 extending from the upper shelf 202 to at least the lower shelf 204 and preferably a distance further, as best seen in FIGS. 27 and 28, to surround a rear mount cavity 209. Extending rearward from the back 208 of the housing back 20 are two upper and lower overhangs 210 and 212 positioned to be hung on the shelves 202 and 204, respectively, as best seen in FIGS. 4 and 8, forming joints 220 and 222. Vertical sidewalls 224*a* and 224*b* extend rearward from the back 208 of the housing back 20 and extend from the upper overhang 210 to at least the lower overhang 212, as best seen in FIG. 14, surrounding a back housing cavity 225. As shown in FIGS. 4 and 8, in the assembled station, the joined rear mount cavity 209 and back housing cavity 225 together form a continuous mounting enclosure 227. As best seen in the enlarged view of FIG. 8 and plan view of FIG. 9, the front surface 206 of the rear mount 14 defining the rear mount cavity 209 fits into the back housing cavity 225. Thus, the mounting enclosure 227 conceals the upper and lower mounting slots 194 and 196 through the range of bidirectional pivotal movement and still permits the bidirectional pivotal movement through the range of pivotal movement, as previously described.

To permit rotation, a pivot pin 226 connects the shelf 202 and overhang 210. A locking screw 228 connects the shelf 204 and the overhang 212. See FIGS. 4 and 80A. Still further, the joints 220 and 222 may be providing mating serrations to allow for multiple rotational positions. To that end, the upper surface of the shelf 202 is formed with radially extending serrations 232 and the upper surface of the shelf 204 is formed with similar serrations 234. Mating serrations 236 and 238 (FIG. 14) are formed on the undersides of the overhangs 210 and 212, respectively. Thus, when mounting the station 10, the housing 12 can be lifted slightly and rotated left or right to the desired position. Then, upper and lower serrations lock the housing into this position when it is lowered back into position.

After hanging the housing 12 and positioning it as desired, the locking screw 228 is secured from the bottom of the housing 12. An access cover 240, shown in FIGS. 35-42, may then be attached over the lower end of the housing.

As shown and described herein, the structures that attach the housing 12 to the rear 14 are integrally formed in the housing back 14. This is ideal as it simplifies assembly and installation. However, it will be appreciated that the articulating mount assembly could be separate and may include a separate adapter or bracket that attaches the rear mount structure to the back of a separate pushbutton station housing.

As used herein, "front" refers to the side of a component that faces the pedestrian user and "rear" refers to the side of the component that faces away from the user. The side referred to as "left" refers to the user's left, and similarly the side referred to as "right" refers to the user's right.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. An accessible pedestrian pushbutton station comprising:

a housing having a front that includes a plunger space;

a push button assembly supported in the housing, the pushbutton assembly comprising:

a plunger with a plunger head having a front and a rear;

at least one detent on the rear of the plunger head;

wherein the plunger space in the front of the housing is sized to receive the plunger head and includes at least one detent receiving notch;

wherein the plunger is mounted in the housing for axial and rotational movement between a fixed position and an adjustment position, wherein in the fixed position, the at least one detent on the rear of the plunger head is received in the at least one detent receiving notch in the plunger space so that rotation without axial movement is prevented, and wherein in the adjustment position, the at least one detent is withdrawn from the at least one detent receiving notch so that rotation of the plunger head is permitted;

a spring assembly for axially biasing the plunger inwardly toward the housing; and a crossing direction arrow removably attached to the front of the plunger.

2. The pushbutton station of claim 1 wherein the at least one detent comprises a plurality of detents and wherein the at least one detent receiving notch comprises a plurality of detent receiving notches.

3. The pushbutton station of claim 2 wherein each of the plurality of detent receiving spaces comprises outwardly sloped sides whereby the corresponding detent will ride up one of the sides in response to rotation of the plunger head.

4. The pushbutton station of claim 1 wherein the plunger further comprises a stem extending rearwardly from the rear of the plunger head, the stem having a free end.

5. The pushbutton station of claim 4 wherein the spring assembly includes an inner annular spring configured to produce the inwardly biasing force on the plunger.

6. The pushbutton station of claim 5 wherein the spring assembly includes an outer annular spring configured to axially bias the plunger outwardly of the housing, and wherein the outwardly biasing force of the outer spring is about equal to the inwardly biasing force of the inner spring.

7. The pushbutton station of claim 6 further comprising an electromagnet assembly for causing the plunger to reciprocate and thereby produce a tactile vibration.

8. The pushbutton station of claim 6 wherein the outer spring is captured between the rear of the plunger head and the housing.

9. The pushbutton station of claim 8 wherein the inner spring is captured between the housing and the free end of the stem of the plunger.

10. The pushbutton station of claim 9 wherein the spring assembly further comprises inner and outer retaining rings, wherein the inner spring is captured between inner and outer retaining rings.

* * * * *